US010280559B2

(12) United States Patent
Goyal

(10) Patent No.: US 10,280,559 B2
(45) Date of Patent: May 7, 2019

(54) PROCESS FOR PRODUCING INCREASED BULK PULP FIBERS, PULP FIBERS OBTAINED, AND PRODUCTS INCORPORATING SAME

(71) Applicant: International Paper Company, Memphis, TN (US)

(72) Inventor: Gopal Goyal, Mason, OH (US)

(73) Assignee: INTERNATIONAL PAPER COMPANY, Memphis, TN (US)

( * ) Notice: Subject to any disclaimer, the term of this patent is extended or adjusted under 35 U.S.C. 154(b) by 16 days.

(21) Appl. No.: 15/793,239

(22) Filed: Oct. 25, 2017

(65) Prior Publication Data

US 2018/0127919 A1 May 10, 2018

Related U.S. Application Data

(60) Provisional application No. 62/415,814, filed on Nov. 1, 2016.

(51) Int. Cl.

| | |
|---|---|
| ***D21C 3/12*** | (2006.01) |
| ***D21C 9/10*** | (2006.01) |
| ***D21C 9/14*** | (2006.01) |
| ***D21C 9/16*** | (2006.01) |
| ***D21H 19/38*** | (2006.01) |
| ***D21H 19/40*** | (2006.01) |
| ***D21H 19/48*** | (2006.01) |
| ***D21H 21/14*** | (2006.01) |
| ***D21C 3/06*** | (2006.01) |
| ***D21C 9/00*** | (2006.01) |
| ***D21H 11/06*** | (2006.01) |

(52) U.S. Cl.

CPC ..... *D21C 3/12* (2013.01); *D21C 3/06* (2013.01); *D21C 9/007* (2013.01); *D21C 9/10* (2013.01); *D21C 9/1057* (2013.01); *D21C 9/14* (2013.01); *D21C 9/163* (2013.01); *D21H 11/06* (2013.01); *D21H 19/385* (2013.01); *D21H 19/40* (2013.01); *D21H 19/48* (2013.01); *D21H 21/14* (2013.01)

(58) Field of Classification Search

USPC ..... 162/91

See application file for complete search history.

(56) References Cited

U.S. PATENT DOCUMENTS

| | | | |
|---|---|---|---|
| 3,919,041 | A | 11/1975 | Wilder |
| 4,913,773 | A | 4/1990 | Knudsen et al. |
| 5,244,541 | A | 9/1993 | Minton |
| 8,535,482 | B2 | 9/2013 | Jiang et al. |
| 2003/0051835 | A1 | 3/2003 | Jewell |

FOREIGN PATENT DOCUMENTS

| | | |
|---|---|---|
| EP | 3002885 | 4/2016 |
| WO | WO-2015/036930 | 3/2015 |

*Primary Examiner* — Mark Halpern

(74) *Attorney, Agent, or Firm* — Thomas W. Barnes, III; Clfford R. Lamar, II

(57) ABSTRACT

Processes for pulping raw pulp material, such as wood chips, to provide pulp fibers having increased bulk, as well as bleaching the resulting pulp fibers to provide bleached pulp fibers having increased bulk. These pulp fibers and bleached pulp fibers may be incorporated into or used various products, such as multi-ply coated paperboards, fluff pulp, etc.

59 Claims, 8 Drawing Sheets

PROCESS FOR PRODUCING INCREASED BULK PULP FIBERS, PULP FIBERS OBTAINED, AND PRODUCTS INCORPORATING SAME

FIELD OF THE INVENTION

The present invention broadly relates to process for pulping raw wood material by cooking that raw wood material (e.g., wood chips) in an aqueous cooking liquor comprising sodium sulfite, and comminuting (refining) the cooked wood material to provide pulp fibers having increased bulk. The present invention also broadly relates to bleaching the resulting pulp fibers with one or more peroxides to provide bleached pulp fibers having suitable brightness. The present invention further broadly relates to the increased bulk bleached pulp fibers obtained, as well as products, such as paperboard, incorporating these increased bulk bleached pulp fibers.

BACKGROUND

Wood comprises two primary components, namely, a fibrous carbohydrate or cellulosic portion and a portion comprising a complex chemical, commonly referred to as lignin. For use in papermaking processes, raw wood material, such as wood chips, which may be converted into pulp fibers which may then be capable of being slurried, suspended, etc., and then deposited as a furnish on a forming screen to form a paper sheet. Such pulp fiber formation may involve physical and/or chemical treatment of the wood chips to alter its chemical form and/or to give such pulp its desired paper properties.

In chemical pulping, these wood chips may be digested with chemical solutions to solubilize a portion of the lignin and to effect the removal of such lignin. After these wood chips have been digested, the resulting cooked wood material may comprise a darkly colored pulp fiber. This darkly colored pulp fiber is commonly referred to as unbleached pulp which may be used in papermaking operations if the color of the resulting paper is unimportant. Where color of the resulting paper is relevant, this darkly colored pulp may then be bleached to increase its whiteness, brightness, etc. Bleaching of this pulp may be carried out in a single stage or in a multi-stage process involving bleaching, caustic extraction and washing operations to provide a bleached, purified and washed pulp fiber. The bleached/purified/washed pulp fiber may then be dried for use at a paper mill.

High-yield pulps may be obtained in yields of, for example, from 65 to 95% of the original weight of the wood chips used. Examples of such pulps may include refiner mechanical pulp, thermomechanical pulp, chemimechanical pulp, etc., such as chemithermomoechanical pulp (CTMP). In the manufacture of CTMP pulp, wood chips may be first impregnated with digestion chemicals and then heated (cooked) to higher temperatures (pre-cooking). These pre-cooked chips may then be defibrated in one or more disc refiners, such as a series of two disc refiners, and may also be subsequently bleached. These high-yield pulp fibers, with or without bleaching, may be used for various products, for example, as bleached fluff pulp in the manufacture of adsorbent products, as pulp fibers for paperboard, newsprint, other types of printing paper, tissue paper, etc.

SUMMARY

According to a first broad aspect of the present invention, there is provided a composition comprising one or more of:

softwood pulp fibers having an ISO brightness of at least about 60 and a coarseness in the range of from about 15 to about 45 mg/100 m. of fiber; or hardwood pulp fibers having an ISO brightness of at least about 80 and a coarseness in the range of from about 5 to about 20 mg/100 m. of fiber, the pulp fibers comprising:

for softwood pulp fibers:
- from about 15 to about 27% by weight acid-insoluble lignin;
- from about 20 to about 25% by weight hemicellulose;
- from about 40 to about 50% by weight cellulose; and
- about 0.4% or less by weight extractives; or for hardwood pulp fibers:
- from about 8 to about 20% by weight acid-insoluble lignin;
- from about 15 to about 25% by weight hemicellulose;
- from about 47 to about 58% by weight cellulose; and
- from about 0.01 to about 0.08% by weight extractives.

According to a second broad aspect of the present invention, there is provided a process for preparing pulp fibers, the process comprising the following steps:

(a) cooking raw wood material comprising one or more of softwoods or hardwoods in an aqueous cooking liquor comprising from about 8 to about 12% sodium sulfite at a temperature in the range of from about 150° to about 200° C. for from about 30 to about 90 minutes to provide cooked wood material; and (b) comminuting the cooked wood material of step (a) using a fiberization energy of at least about 50 kj/kg to provide pulp fibers in a yield of from about 50 to about 85% and having:

for softwood pulp fibers, an ISO brightness of at least about 60 and a coarseness in the range of from about 15 to about 45 mg/100 m., the softwood pulp fibers comprising:
- from about 23 to about 27% by weight acid-insoluble lignin;
- from about 20 to about 23% by weight hemicellulose;
- from about 40 to about 45% by weight cellulose; and
- about 0.4% or less by weight extractives; or for hardwood pulp fibers, an ISO brightness of at least about 80 and a coarseness in the range of from about 5 to about 20 mg/100 m., the hardwood pulp fibers comprising:
- from about 15 to about 20% by weight acid-insoluble lignin;
- from about 15 to about 25% by weight hemicellulose;
- from about 47 to about 52% by weight cellulose; and
- about 0.05 to about 0.08% by weight extractives.

According to a third broad aspect of the present invention, there is provided a process for preparing bleached pulp fibers, the process comprising the following steps:

(a) cooking raw wood material comprising one or more of softwoods or hardwoods in an aqueous cooking liquor comprising from about 8 to about 12% sodium sulfite at a temperature in the range of from about 150° to about 200° C. for from about 30 to about 90 minutes to provide cooked wood material;

(b) comminuting the cooked wood material of step (a) using a fiberization energy of at least about 50 kj/kg to provide pulp fibers in a yield of about 50 to about 85%; and (c) bleaching the pulp fibers of step (b) to provide bleached softwood pulp fibers having an ISO brightness of at least about 60 and a coarseness of from about 15 to about 45 mg/100 m. of fiber; or hardwood pulp fibers having an ISO brightness of at least about 80 and a coarseness in the range of from about 5 to about 20 mg/100 m. of fiber, the bleached pulp fibers comprising:

for bleached softwood pulp fibers:

from about 15 to about 20% by weight acid-insoluble lignin;

from about 22 to about 25% by weight hemicellulose;

from about 46 to about 50% by weight cellulose; and about 0.01% or less by weight extractives; or for bleached hardwood pulp fibers:

from about 8 to about 12% by weight acid-insoluble lignin;

from about 15 to about 25% by weight hemicellulose;

from about 54 to about 58% by weight cellulose; and from about 0.01 to about 0.04% by weight extractives.

According to a fourth broad aspect of the present invention, there is provided an article comprising paperboard having a thickness of from about 10 to about 24 mils, the paperboard comprising:

an inner ply having a first and second side, a basis weight in the range of from about 100 to about 150 gsm, and a bulk of at least about 1.6 cc/g, the inner ply comprising at least about 40% by weight of softwood pulp fibers, and up to about 60% by weight of hardwood pulp fibers, the softwood pulp fibers having an ISO brightness of at least about 60 and the hardwood pulp fibers having an ISO brightness of at least about 80, and wherein:

the softwood pulp fibers comprise:

from about 15 to about 27% by weight acid-insoluble lignin;

from about 20 to about 25% by weight hemicellulose;

from about 40 to about 50% by weight cellulose; and about 0.4% or less by weight extractives; and the hardwood pulp fibers comprise:

from about 8 to about 20% by weight acid-insoluble lignin;

from about 15 to about 25% by weight hemicellulose;

from about 47 to about 58% by weight cellulose; and from about 0.01 to about 0.08% by weight extractives;

a first outer ply comprising a paper substrate adjacent one of the first and second sides and having a basis weight of in the range of from about 35 to about 55 gsm; and a second outer ply comprising a paper substrate adjacent the other of the first and second sides and having a basis weight in the range of from about 15 to about 35 gsm;

wherein at least one of the first and second outer plies has an outer coating thereon in an amount of from about 10 to about 30 gsm, the outer coating comprising from about 55 to about 85% solids by weight of one or more coating pigments and from about 10 to about 20% solids by weight of one or more coating pigment binders.

BRIEF DESCRIPTION OF THE DRAWINGS

The invention will be described in conjunction with the accompanying drawings, in which.

DETAILED DESCRIPTION

Figure 1:
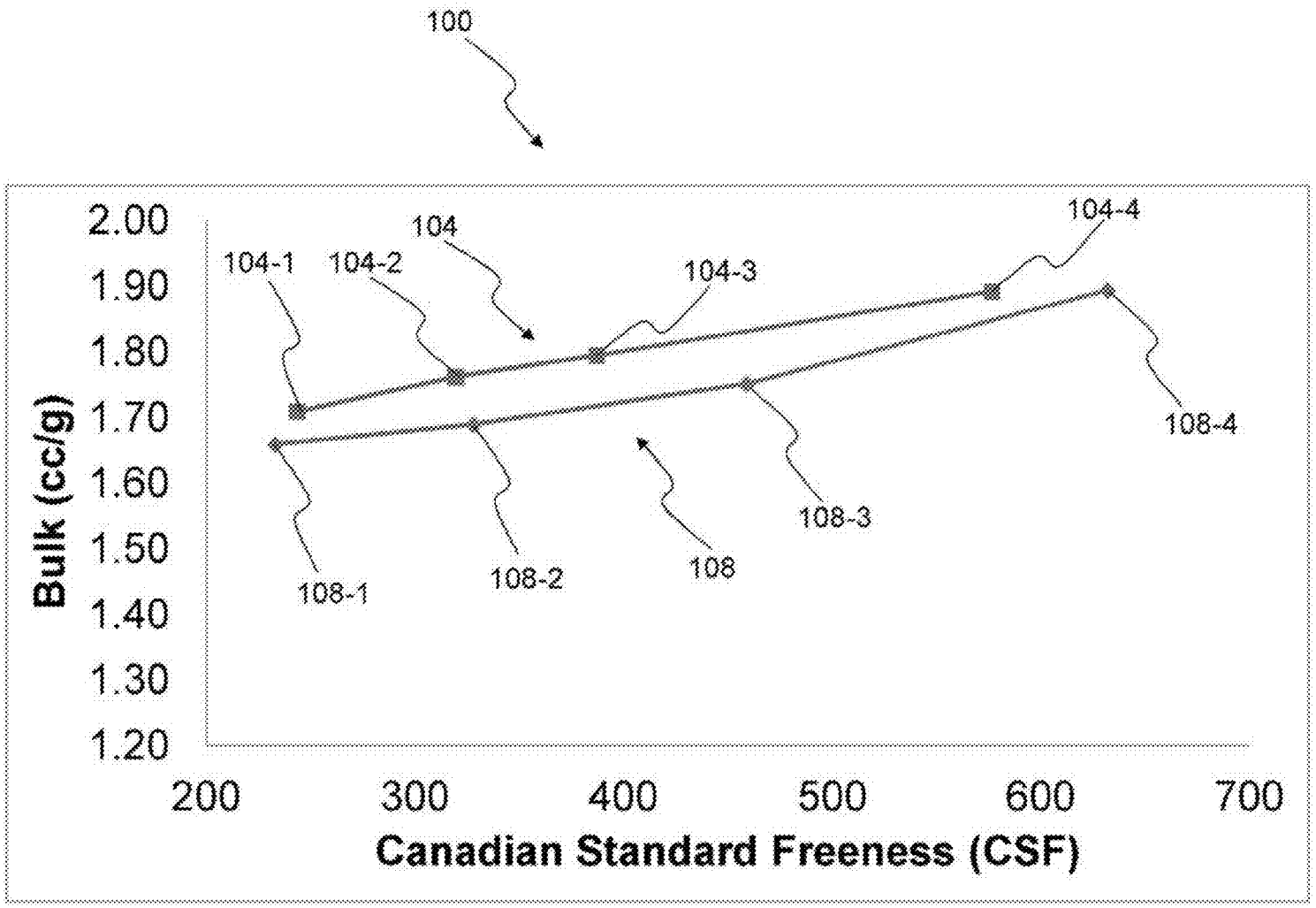
FIG. 1 is a graphical plot of bulk (in cc/g) values versus Canadian Standard Freeness (CSF) values of cooked hardwood pulp fibers prepared according to embodiment of the process of the present invention at two different cooking temperatures.

It is advantageous to define several terms before describing the invention. It should be appreciated that the following definitions are used throughout this application.

Definitions

Where the definition of terms departs from the commonly used meaning of the term, applicant intends to utilize the definitions provided below, unless specifically indicated.

For the purposes of the present invention, directional terms such as "outer," "inner," "upper," "lower," "top," "bottom," "side," "front," "frontal," "forward," "rear," "rearward," "back," "trailing," "above," "below," "left," "right," "horizontal," "vertical," "upward," "downward," etc. are merely used for convenience in describing the various embodiments of the present invention. For example, the embodiment of the present invention illustrated in FIGS. 1 through 8, may be oriented in various ways.

For the purposes of the present invention, the term "paper fibers" refers to any fibrous material which may be used in preparing a fibrous paper web. Paper making fibers may include pulp (wood) fibers (e.g., softwood fibers and/or hardwood fibers), kraft fibers (e.g., pulp fibers produced by the kraft pulping process), as well as wood fibers produced by soda, sulfite, magnefite, cold soda, NSSC, etc., pulp making processes, synthetic fibers, waste paper fibers, recycled paper fibers, fibers from any of hemp, jute, ramie, flax, cotton linters, abaca, wood waste, straw, bagasse, bamboo, sisal, synthetic (e.g., bicomponent) fibers, etc., as well as any combinations of such fibers.

For the purposes of the present invention, the term "softwood fibers" refers to fibrous pulps derived from the woody substance of coniferous trees (gymnosperms) such as varieties of fir, spruce, pine, etc., for example, loblolly pine, slash pine, Colorado spruce, balsam fir, Douglas fir, jack pine, *radiata* pine, white spruce, lodgepole pine, redwood, etc. North American southern softwoods and northern softwoods may be used to provide softwood fibers, as well as softwoods from other regions of the world. Inclusion of softwood fibers tends to impart greater bending stiffness in paper substrates, but also tends to impart rougher and less smooth surfaces in paper substrates, such as those comprising kraft paper fibers.

For the purposes of the present invention, the term "hardwood fibers" refers to fibrous pulps derived from the woody substance of deciduous trees (angiosperms) such as birch, oak, beech, maple, *eucalyptus*, poplars, etc. Inclusion of hardwood fibers in paper substrates tends to impart smoother surfaces in paper substrates.

For the purposes of the present invention, the term "digester" refers to pressure vessel for cooking wood material to convert the wood material to pulp fibers.

For the purposes of the present invention, the term "raw wood material" refers to wood material suitable for cooking to obtain pulp fibers and which may have been comminuted, cut, sliced, chopped, etc., to form, for example, one or more of: wood chips; wood slivers; wood pieces; wood shards; wood flakes; wood sawdust; wood chunks; etc.

For the purposes of the present invention, the term "cooked pulp fibers" refers to pulp fibers which have been obtained by cooking raw wood material, such as wood chips, in a digester.

For the purposes of the present invention, the term "bleached fibers" refers to paper fibers which have been subjected to a bleaching process to, for example, increase the brightness, whiteness, etc., of the paper substrate prepared from such fibers.

For the purposes of the present invention, the term "delignification," as in, for example, a "delignification stage," etc., refers to the removal of lignin from the pulp fibers, for example, by chemical processes using, for example chlorine dioxide, etc.

For purposes of the present invention, the term "H-factor" refers to a dimensionless value obtained from a kinetic model of the rate of delignification in pulping which combines temperature and time and which assumes that delignification is a single reaction. See Vroom, K. E., "The 'H' factor: A Means of Expressing Cooking Time and Temperatures as a Single variable," *Pulp and Paper Magazine*, Canada 58C (1957) pp. 220-231, on calculating H-factors, using the equation: H-factor$=\int_0^t \exp(43.2-16115/T)\,dt$, wherein t is time and T is the temperature in degrees Kelvin (K).

For the purposes of the present invention, the term "D stage" refers to a delignification stage carried out on pulp fibers to remove lignin.

For the purposes of the present invention, the term "Do stage" refers to a delignification stage carried out on pulp fibers by using chlorine dioxide oxidation.

For the purposes of the present invention, the term "lignin" refers to those natural phenolic polymers that bind fibers together in wood and which chemically comprise cross-linked phenolic polymers. The amounts of lignin present in the raw wood material and pulp fiber is measured according to the present invention in terms of the amount of "acid-insoluble lignin" present by using the TAPPI 60(10): 143 (1997) method.

For purposes of the present invention, the term "hemicellulose" refers to heteropolymers (matrix polysaccharides), such as arabinoxylans, present along with cellulose in plant cell walls, including those present in raw wood material. The amounts of hemi-celluose present in the raw wood material and pulp fiber is measured according to the present invention by using the TAPPI T-249 cm-09 method.

For purposes of the present invention, the term "cellulose" refers to those polysaccharides consisting of linear chains of, for example, several hundred to many thousands of $\beta(1\rightarrow4)$ linked D-glucose units, and which are present in raw wood materials. The amounts of cellulose present in the raw wood material and pulp fiber is measured according to the present invention by using the TAPPI T-249 cm-09 method.

For the purposes of the present invention, the term "extractive(s)" refers to certain low molecular mass materials obtained by extraction from pulp fibers, such as saturated or unsaturated fatty acids, etc. The amounts of extractive(s) present in the raw wood material and pulp fiber is measured according to the present invention by using the TAPPI T-204 cm-07 method.

For the purposes of the present invention, the term "bleaching," as in, for example, a "bleaching stage," etc., refers to a chemical process which carried out on wood pulp fibers to increase the whiteness, brightness, etc., of the pulp fibers by one or more bleaching agents.

For the purposes of the present invention, the term "bleaching agents" refers to chemical agents which may be to bleach paper fibers. Bleaching agents which may include one or more of: chlorine; hypochlorite; chlorine dioxide; oxygen; hydrogen peroxide; ozone, optical brightening agents, etc.

For the purposes of the present invention, the term "P stage" refers to a bleaching stage wherein bleaching of the pulp fibers is carried out by using one or more peroxide bleaching agents. Numerical designations after the "P," such as "P1," "P2," etc., refers to the order in which that particular peroxide bleaching stage occurs in the bleaching sequence where there is more than one peroxide bleaching stage.

For the purposes of the present invention, the term "peroxide bleaching agent" refers to peroxide compounds which may be used in bleaching. Peroxide bleaching agents may include one or more of: hydrogen peroxide; etc.

For the purposes of the present invention, the term "XP stage" refers to a bleaching stage wherein bleaching of the pulp fibers with peroxide bleaching agents is carried out in the presence of one or more optical brightening agents (OBAs).

For the purposes of the present invention, the term "bulk" refers to the volume or thickness of the paper fibers in relation to their weight. Bulk is the reciprocal of the density (weight per unit volume), and may be calculated from caliper and basis weight of a paper substrate comprising the paper fibers. Decreasing the bulk (or in other words, increasing the density) of, for example, a paper substrate sheet, causes that sheet to be smoother, glossier, less opaque, darker, lower in strength, etc. Bulk is measured by TAPPI T-220 method and is reflected in units of cc/g.

For the purposes of the present invention, the term "coarseness" refers to the thickness of the cell walls of those pulp fibers. Coarseness of pulp fibers is measured in terms of weight per unit length of the fibers (i.e., mg./100 m. of fiber), and may be measured by the TAPPI T-234 method.

For the purposes of the present invention, the term "pulp yield" refers to the ratio of pulp fiber solid mass relative to the solid mass of the original wood chips that the pulp fiber mass was derived from. Pulp yield may be calculated by a gravimetric method.

For the purposes of the present invention, the term "consistency" refers to the percentage of solids present in a pulp fiber mixture. Consistency of pulp fiber mixtures may be measured by the TAPPI T-240 standard test method.

For the purposes of the present invention, the term "freeness" refers to ease with which a paper fiber matrix releases water during a standard test by gravity. Freeness is reflected in terms of Canadian Standard Freeness (CSF) units and may be measured by the TAPPI T-227 standard test method.

For the purposes of the present invention, the term "paper smoothness" refers to the extent to which the paper substrate surface, size surface layer surface, coating surface, etc., deviates from a planar or substantially planar surface, as affected by the depth of the paper substrate/coating layer, paper substrate/coating layer width, numbers of departure from that planar surface, etc. Paper smoothness may be measured in terms of Parker Print Smoothness (PPS) according to TAPPI test method T 555 om-99 at a clamping pressure of 10 kgf/cm$^2$. Parker Print Smoothness (PPS) values reflect the degree of "microroughness" of the paperboard or coating surface. The higher the Parker Print Smoothness value, the rougher the paper substrate surface, coating surface, etc. Conversely, the lower PPS value, the smoother the paper substrate surface, coating surface, etc. Paper smoothness may be also measured in terms of Sheffield smoothness values. Sheffield smoothness values may be measured by TAPPI test method T 538 om-01, in Sheffield Units (SUs).

For the purposes of the present invention, the term "tensile strength" refers to a stress as measured per unit area of a paper substrate. The tensile strength of a paper substrate may be measured in the machine direction (MD) and/or cross-machine (CD) direction of the printable substrate by using TAPPI method T-494, in units of, for example, lbs per inch (lbs/in.).

For the purposes of the present invention, the term "tensile index" refers to the tensile strength of the paper substrate in Newtons per meter (N/m) divided by the basis weight (grammage) in grams per square meter (gsm) of that paper substrate.

For the purposes of the present invention, the term "Gurley Stiffness" refers to a type of bending resistance of paper, paperboard, etc., by measuring the force required to bend a specimen of such paper, paperboard, etc., under certain controlled conditions. Gurley Stiffness of a paper substrate may be measured in the machine direction (MD) and/or cross-machine (CD) direction of the printable substrate by using TAPPI method T-543 om-05, in units of milligrams of force (mgf), referred to hereafter as Gurley units.

For the purposes of the present invention, the term "MD" refers to machine direction of the printable substrate, i.e., is used in the conventional papermaking sense of the direction the paper substrate moved during its formation.

For the purposes of the present invention, the term "CD" refers to the cross-machine direction, i.e., is used in the conventional papermaking sense of the direction transverse (e.g., orthogonal) to the machine direction (MD).

For the purposes of the present invention, "Taber Stiffness Units" are defined as the bending moment of ⅕ of a gram applied to a 1.5" wide specimen of paperboard at a 5 centimeter test length, flexing it to an angle of 15°. A Taber Stiffness Unit is the equivalent of one gram centimeter. The method used herein for measuring Taber Stiffness is TAPPI T566 (Bending Resistance (Stiffness) of Paper).

For the purposes of the present invention, the term "Huygen Bond" refers to the degree of internal bonding of the paper substrate/paper fibers and is measured in units of ft. lbs/in$^2$. The Huygen Bond values of a paperboard may be measured in the machine direction (MD), as well as the cross-machine (CD) direction by using TAPPI T569 om-99 (Internal Bond Strength (Scott Type)).

For the purposes of the present invention, the term "caliper," refers to the thickness of a sheet, web, etc., of a material, for example, a material comprising the paper web, with or without layers or coatings, before or after calendaring, in mils, as determined by measuring the distance between smooth, flat plates at a defined pressure.

For the purposes of the present invention, the term "mil(s)" is used in the conventional sense of referring to thousandths of an inch and is also referred to interchangeably herein as "points."

For the purposes of the present invention, the term "optical brightener agent (OBA)" refers to certain fluorescent materials which may increase the brightness (e.g., white appearance) of paper substrate surfaces by absorbing the invisible portion of the light spectrum (e.g., from about 340 to about 370 nm) and converting this energy into the longer-wavelength visible portion of the light spectrum (e.g., from about 420 to about 470 nm). In other words, the OBA converts invisible ultraviolet light and re-emits that converted light into blue to blue-violet light region through fluorescence. OBAs may also be referred to interchangeably as fluorescent whitening agents (FWAs) or fluorescent brightening agents (FBAs). These OBAs may include one or more of: 4,4'-bis-(triazinylamino)-stilbene-2,2'-disulfonic acids, 4,4'-bis-(triazol-2-yl)stilbene-2,2'-disulfonic acids, 4,4'-dibenzofuranyl-biphenyls, 4,4'-(diphenyl)-stilbenes, 4,4'-distyryl-biphenyls, 4-phenyl-4'-benzoxazolyl-stilbenes, stilbenzyl-naphthotriazoles, 4-styryl-stilbenes, bis-(benzoxazol-2-yl) derivatives, bis-(benzimidazol-2-yl) derivatives, coumarins, pyrazolines, naphthalimides, triazinyl-pyrenes, 2-styryl-benzoxazole or -naphthoxazoles, benzimidazole-benzofurans or oxanilides, etc, See commonly assigned U.S. Pat. No. 7,381,300 (Skaggs et al.), issued Jun. 3, 2008, the entire contents and disclosure of which is herein incorporated by reference. In particular, these OBAs may comprise, for example, one or more stilbene-based sulfonates (e.g., disulfonates, tetrasulfonates, or hexasulfonates) which may comprise one or two stilbene residues. Illustrative examples of such anionic stilbene-based sulfonates may include 1,3,5-triazinyl derivatives of 4,4'-diaminostilbene-2,2'-disulphonic acid (including salts thereof), and in particular the bistriazinyl derivatives (e.g., 4,4-bis(triazine-2-ylamino)stilbene-2,2'-disulphonic acid), the disodium salt of distyrlbiphenyl disulfonic acid, the disodium salt of 4,4'-di-triazinylamino-2,2'-di-sulfostilbene, etc. Commercially available disulfonate, tetrasulfonate and hexasulfonate stilbene-based OBAs may also be obtained, for example, from Ciba Geigy under the trademark TINOPAL®, from Clariant under the trademark LEUCOPHOR®, from Lanxess under the trademark BLANKOPHOR®, and from 3V under the trademark OPTIBLANC®. OBAs may be used in embodiments of the process of the present invention in amounts of, for example, from about 0.2 to about 2% by weight of the pulp fibers being bleached, such as from about 0.4 to about 0.6 by weight of the pulp fibers being bleached.

For the purposes of the present invention, the term "unrefined fibers" refers to pulp fibers which have not been refined, i.e., have not be subjected to a process of mechanical treatment, such as beating, to develop or modify the pulp fibers, often to increase fiber bonding strength and/or improve surface properties. See G. A. Smook, Handbook for Pulp and Paper Technologists ($2^{nd}$ Edition, 1992), page 191-202, the entire contents and disclosure of which is herein incorporated by reference, for a general description of the refining of pulp fibers.

For the purposes of the present invention, the term "CTMP fibers" refers to chemithermomechanical pulp (CTMP) fibers which have subjected to a combination of chemical, thermal, and mechanical treatment. As used herein, CTMP fibers refer to fibers which have been treated by chemical, thermal, and mechanical treatment in any order of such treatments, including chemi-thermo-mechanical (C-T-M) pulp fibers, thermo-chemi-mechanical (T-C-M) pulp fibers, thermo-mechanical-chemi (T-M-P) pulp fibers, long fiber chemi-mechanical pulp/chemically treated long pulp fibers (LFCMP/CTLF), etc. See G. A. Smook, Handbook for Pulp and Paper Technologists ($2^{nd}$ Edition, 1992), pages 60-65, the entire contents and disclosure of which is herein incorporated by reference, for a general description of chemithermomechanical pulping (CTMP) for preparing CTMP fibers.

For the purposes of the present invention, the term "bleached CTMP fibers (also referred to interchangeably as "BCTMP fibers" refers to bleached chemithermomechanical pulp (CTMP) fibers which have subjected to one or more bleaching treatments, bleached chemi-thermo mechanical pulp (BCTMP) fibers, neutral sulfite semi chemical-pulp (NSSC) fibers, alkaline peroxide mechanical pulp (APMP/AAP) fibers, etc.

For the purposes of the present invention, the term "fluff pulp" refers to a fibrous cellulosic matrix comprising wood pulp fibers which may be comminuted to provide an air-laid fibrous structure. Fluff pulps may also be referred to as "fluffy pulp," or "comminution pulp." Some illustrative examples of commercially available fluff pulp may include one or more of: RW Supersoft™, Supersoft L™, RW Supersoft Plus™, GT Supersoft Plus™, RW Fluff LITE™, RW Fluff 110™, RW Fluff 150™, RW Fluff 160™, GP 4881™, GT Pulp™, RW SSP™, GP 4825™, etc.

For the purposes of the present invention, the term "paper substrate" refers to a fibrous paper web that may be formed, created, produced, etc., from a mixture, furnish, etc., comprising paper fibers, internal sizing agents, etc., plus any other optional papermaking additives such as, for example, paper fillers, wet-strength agents, optical brightening agents, etc. The paper substrate may be in the form of a continuous roll, a discrete sheet, etc.

For the purposes of the present invention, the term "paperboard" refers to paper substrate comprising a single ply (layer) of a paperboard having a caliper of from about 8 to about 28 mils (points), such as from about 12 to about 24 mils (points), or a multi-ply (multi-layer) paperboard having a caliper of from about 10 to about 24 mils (points), such as from about 12 to about 18 mils (points). The paperboard may be in the form of a continuous roll, a discrete sheet, a packaging material blank such as for making a container, box, etc.

For the purposes of the present invention, the term "fiberization energy," (also known as "shred energy") refers to the amount of energy in kilojoules per kilogram of pulp fiber (kj/kg) required to comminute (e.g., defiberize, disintegrate, shred, fragment, etc.) a cooked wood material into pulp fibers by using, for example, a hammermill (such as a Kamas Type H 01 Laboratory Defribrator manufactured by Kamas Industri AB). As the amount of softwood in the cooked wood material increases, the amount of fiberization (shred) energy required to comminute that material into the corresponding pulp fiber normally increases as well. To determine the fiberization (shred) energy required for the pulp fiber, samples of pulp fiber sheets may be conditioned at 72° F. and 50% (±5) relative humidity for at least 4 hours. These conditioned sample pulp fiber sheets are then cut (in the machine direction) into 4 strips per sample that are 2 inches wide by 24 inches in length, or for lab formed sheets, ~1 inch is trimmed from the edge, with the sheets then being cut into 2 inch wide strips using 3-4 strips per sample. After weighing, the strips are then fed into the Kamas Type H 01 Laboratory Defribrator which is set at a rotor speed of 3000 rpm with a feed time of 1 g/sec. and using 10 mm screen. The energy required to comminute these strips in the Kamas Type H 01 Laboratory Defribrator is normally measured and displayed in, for example, watt hours (wH). The fiberization energy may then be calculated by using the following equation: fiberization energy (in kJ/kg)=3600× energy measured (in wH)÷fiberized fiber weight (in grams).

For the purposes of the present invention, the term "shred quality," (also referred as "fluff pulp fiber quality") refers to the quality of a fluff pulp in terms of the degree to which the fibers are present as fiber agglomerates (also known as "Nits"). The lower the percentage of Nits present, the better the shred quality of the fluff pulp. Shred quality may be determined by the MTS Nit counter method. The MTS Nit counter determines the quantity of Nits in a sample of fiberized fluff pulp by fractionating the fiberized fluff pulp on a 14 mesh screen. The sample of fiberized fluff pulp to be measured is placed on top of the 14 mesh screen with a vacuum being applied beneath the screen while simultaneously mixing the fiberized fluff pulp with a rotating high pressure air stream. After a period of time, typically 10-20 minutes, the fiberized fluff pulp that remains on (i.e., does not pass through) the 14 mesh screen is determined gravimetrically as a percentage of the total weight of the fiberized fluff sample. The fiberized fluff pulp that is retained on the 14 mesh screen is considered the "Nits."

For the purposes of the present invention, the term "absorption time," refers to the time required by the fluff pulp to absorb a liquid (i.e., a 0.9% saline solution). See U.S. Pat. No. 8,535,482 (Jiang et al.), issued Sep. 17, 2013, the entire disclosure and contents of which is herein incorporated by reference, under the heading "Scan Absorption Test" for measuring the absorption time of a fluff pulp.

For the purposes of the present invention, the term "absorption capacity," refers to the amount of a liquid (i.e., a 0.9% saline solution) which is absorbed by a fluff pulp. See U.S. Pat. No. 8,535,482 (Jiang et al.), issued Sep. 17, 2013, the entire disclosure and contents of which is herein incorporated by reference, under the heading "Scan Absorption Test" for measuring the absorption capacity of a fluff pulp.

For the purposes of the present invention, the term "printable paper substrate" refers to any paper substrate which may be printed on with a printer colorant. Printable paper substrates may include webs, sheets, strips, etc., may be in the form of a continuous roll, a discrete sheet, etc.

For the purposes of the present invention, the term "air-laid fibrous structure" refers to a nonwoven, bulky, porous, soft, fibrous structure obtained by air-laying comminuted fluff pulp web and/or fluff pulp fibers, and which may optionally comprise synthetic fibers such as bicomponent fibers. Air-laid fibrous structures may include air-laid fibrous cores, air-laid fibrous layers, etc.

For the purposes of the present invention, the term "comminuting" refers to defibrizing, disintegrating, shredding, fragmenting, etc., a fluff pulp web and/or fluff pulp fibers to provide an air-laid structure.

For the purposes of the present invention, the term "synthetic fibers" refers to fibers other than wood pulp fibers (e.g., other than pulp fibers) and which may be made from, for example, cellulose acetate, acrylic, polyamides (such as, for example, nylon, etc.) polyacrylics (such as, for example, polyacrylamide, polyacrylonitrile, esters of methacrylic acid and acrylic acid, etc.), polyolefins (such as, for example, polyethylene, polypropylene, etc.), polydienes (such as, for example, polybutadiene, polyisoprene, polynorbomene, etc.), polyepoxides, polyesters, polyethers (such as, for example, polyethylene glycol(polyethylene oxide), polybutylene glycol, polypropylene oxide, polyfluorocarbons, etc.

For the purposes of the present invention, the term "bicomponent fibers" refers to synthetic fibers comprising a core and sheath configuration. The core and sheath portions of these bicomponent fibers may be made from various polymers. For example, bicomponent fibers may comprise a PE (polyethylene) or modified PE sheath which may have a PET (polyethylene terephthalate) or PP (polypropylene) core.

For the purposes of the present invention, the term "basis weight," refers to the grammage of the wood pulp fibers, fibrous web, etc., in the paper substrate as determined by TAPPI test T410. See G. A. Smook, Handbook for Pulp and Paper Technologists ($2^{nd}$ Edition, 1992), page 342, Table 22-11, the entire contents and disclosure of which is herein incorporated by reference, which describes the physical test for measuring basis weight. Basis weights used herein are measured in grams per square meter (gsm) but may also be converted to corresponding basis weights in terms of lbs/1300 $ft^2$ or lbs/3000 $ft_2$. For example, a basis weight of 75 gsm corresponds to a basis weight of about 20 lbs/1300 $ft^2$ or about 46.1 lbs/3000 $ft^2$.

For the purposes of the present invention, the term "paper filler" refers commonly to mineral products (e.g., calcium carbonate, kaolin clay, etc.) which may be used in paper making to reduce materials cost per unit mass of the paper, increase opacity, increase smoothness, etc. These mineral products may be finely divided, for example, the size range of from about 0.5 to about 5 microns.

For the purposes of the present invention, the term "paper pigment" refers to a material (e.g., a finely divided particulate matter) which may be used or may be intended to be used to affect optical properties of paper substrates, and may include materials used as paper fillers. Paper pigments may include one or more of: calcium carbonate, kaolin clay, calcined clay, modified calcined clay, aluminum trihydrate, titanium dioxide, talc, plastic pigment, amorphous silica, aluminum silicate, zeolite, aluminum oxide, colloidal silica, colloidal alumina slurry, etc.

For the purposes of the present invention, the term "coating pigments" refers to materials which may be used or may be intended to be used to affect optical properties of coatings for paper substrates. Coating pigments may include one or more of: calcium carbonate, clay, talc, calcium sulfate, plastic pigment, titanium dioxide, silica, calcium sulfoaluminate (known also as Satin White), etc.

For the purposes of the present invention, the term "coating pigment binders" refers to binders for coating pigments which may be used to improve the coating pigment binding strength of the coating. Coating pigment binders may be hydrophilic. Suitable coating pigment binders may include one or more synthetic or naturally occurring polymers (or a combination of different polymers), for example, a polyvinyl alcohol (PVOH), starch binders, proteinaceous adhesives such as, for example, casein or soy proteins, etc.; polymer latexes such as styrene butadiene rubber latexes, acrylic polymer latexes, polyvinyl acetate latexes, styrene acrylic copolymer latexes, etc., or a combination thereof.

For the purposes of the present invention, the term "starch binder" refers to a binder agent for paper pigments which comprises starch, a starch derivative, etc., or a combination thereof. Suitable starch binders may be derived from a natural starch, e.g., natural starch obtained from a known plant source, for example, wheat, maize, potato, tapioca, etc. The starch binder may be modified (i.e., a modified starch) by one or more chemical treatments known in the paper starch binder art, for example, by oxidation to convert some of OH groups to —COOH groups, etc. In some cases the starch binder may have a small proportion of acetyl groups. Alternatively, the starch binder may be chemically treated to render it cationic (i.e., a cationic starch) or amphoteric (i.e., an amphoteric starch), i.e., with both cationic and anionic charges. The starch binder may also be a starch converted to a starch ether, or a hydroxyalkylated starch by replacing some —OH groups with, for example, —$OCH_2CH_2OH$ groups, —$OCH2CH_3$ groups, —$OCH_2CH_2CH_2OH$ groups, etc. A further class of chemically treated starch binders which may be used are known as the starch phosphates. Alternatively, raw starch may be hydrolyzed by means of a dilute acid, an enzyme, etc., to produce a starch binder in the form of a gum of the dextrin type.

For the purposes of the present invention, the term "calendered paper" refers to a paper substrate which has been subjected to calendering to, for example, smooth out the material for enabling printing on the material, to increase the gloss on the material surface, etc. For example, calendering may involve a process of using pressure (and optionally temperature and moisture) for embossing a smooth surface on the still rough material surface. Calendering may be carried out on a calender which may comprise a series of calender rolls at the end of, for example, a papermaking machine (on-line), or separate from the papermaking machine (off-line). Calendering may include supercalendering, hot-soft calendering, moisture-gradient calendering, extended nip calendering, belt calendering, etc. See G. A. Smook, Handbook for Pulp and Paper Technologists ($2^{nd}$ Edition, 1992), pages 273-78, the entire contents and disclosure of which is herein incorporated by reference, for a general description of calendering, as well as devices for carrying out calendering, that may be useful herein.

For the purposes of the present invention, the term "solids basis" refers to the weight percentage of each of the respective solid materials (e.g., paper pulp fibers, etc.) present in, etc., in the absence of any liquids (e.g., water). Unless otherwise specified, all percentages given herein for the solid materials are on a solids basis.

For the purposes of the present invention, the term "solids content" refers to the percentage of non-volatile, non-liquid components (by weight) that are present in the composition, etc.

For the purposes of the present invention, the term "calcium carbonate" refers various calcium carbonates which may be used as paper fillers, such as precipitated calcium carbonate (PCC), ground calcium carbonate (GCC), modified PCC and/or GCC, etc.

For the purposes of the present invention, the term "precipitated calcium carbonate (PCC)" refers to a calcium carbonate which may be manufactured by a precipitation reaction and which may used as a paper filler. PCC may comprise almost entirely of the calcite crystal form of $CaCO_3$. The calcite crystal may have several different macroscopic shapes depending on the conditions of production. Precipitated calcium carbonates may be prepared by the carbonation, with carbon dioxide ($CO_2$) gas, of an aqueous slurry of calcium hydroxide ("milk of lime"). The starting material for obtaining PCC may comprise limestone, but may also be calcined (i.e., heated to drive off $CO_2$), thus producing burnt lime, CaO. Water may added to "slake" the lime, with the resulting "milk of lime," a suspension of $Ca(OH)_2$, being then exposed to bubbles of $CO_2$ gas. Cool temperatures during addition of the $CO_2$ tend to produce rhombohedral (blocky) PCC particles. Warmer temperatures during addition of the $CO_2$ tend to produce scalenohedral (rosette-shaped) PCC particles. In either case, the end the reaction occurs at an optimum pH where the milk of lime has been effectively converted to $CaCO_3$, and before the concentration of $CO_2$ becomes high enough to acidify the suspension and cause some of it to redissolve. In cases where the PCC is not continuously agitated or stored for many days, it may be necessary to add more than a trace of such anionic dispersants as polyphosphates. Wet PCC may have a weak cationic colloidal charge. By contrast, dried PCC may be similar to most ground $CaCO_3$ products in having a negative charge, depending on whether dispersants have been used. The calcium carbonate may be precipitated from an aqueous solution in three different crystal forms: the vaterite form which is thermodynamically unstable, the calcite form which is the most stable and the most abundant in nature, and the aragonite form which is metastable under normal ambient conditions of temperature and pressure, but which may convert to calcite at elevated temperatures. The aragonite form has an orthorhombic shape that crystallizes as long, thin needles that may be either aggregated or unaggregated. The calcite form may exist in several different shapes of which the most commonly found are the rhombohedral shape having crystals that may be either aggregated or unaggregated and the scalenohedral shape having crystals that are generally unaggregated.

For the purposes of the present invention, the term "coating" refers to a composition for imparting enhanced print quality, improved brightness, improved gloss, etc., properties to a coated paper substrate (e.g., paperboard), and which may comprise: an aqueous solvent (e.g., water), one or more coating pigments such as, for example, calcium carbonate, clay, etc., coating pigment binders such as, for example, one or more of: styrene butadiene rubber latexes, acrylic polymer latexes, polyvinyl acetate latexes, styrene acrylic copolymer latexes, etc, as well as one or more optional ingredients, such as calcium sulfate lubricant, dispersants (such as RomNova Accumer 9300), viscosity modifiers (such Eka-L237), etc. These coatings may be applied to the surface(s) of the paper substrate by, for example, by various coating devices such as an air-knife coater, rod coater, blade coater, size press, dip coater, slot extrusion coater, etc.

For the purposes of the present invention, the term "opacity" refers to the ability of a paper substrate to hide things such as print images on subsequent sheets or printed on the back, e.g., to minimize, prevent, etc., showthrough, etc. As used herein, opacity of the paper substrate may be measured by, for example, in terms of TAPPI opacity and showthrough. TAPPI opacity may be measured by T425 om-91.

For the purposes of the present invention, the term "brightness" refers to the diffuse reflectivity of paper, for example, at a mean wavelength of light of 457 nm. As used herein, brightness of the paper substrate may be measured in terms of ISO Brightness which measures brightness using, for example, an ELREPHO Datacolor 450 spectrophotometer, according to test method ISO 2470-1, using a C illuminant with UV included.

For the purposes of the present invention, the term "room temperature" refers to the commonly accepted meaning of room temperature, i.e., an ambient temperature of 20° to 25° C.

For the purposes of the present invention, the term "comprising" means various compounds, components, polymers, ingredients, substances, materials, layers, steps, etc., may be conjointly employed in embodiments of the present invention. Accordingly, the term "comprising" encompasses the more restrictive terms "consisting essentially of" and "consisting of."

For the purposes of the present invention, the term "and/or" means that one or more of the various compositions, compounds, polymers, ingredients, components, elements, capabilities, layers, steps, etc., may be employed in embodiments of the present invention.

Description

In pulp fibers prepared by embodiments of cooking and comminuting (refining) processes according to the present invention have increased bulk (in cc/g), comparable to the bulk of pulp fibers obtained by prior bleached chemithermomechanical (BCTMP) pulp fibers. These increased bulk pulp fibers, when bleached by embodiments of bleaching processes according to the present invention, may have an ISO brightness of at least about 60 (for bleached softwood pulp fibers) and an ISO brightness of at least about 80 (for bleached hardwood pulp fibers). These higher bulk bleached pulp fibers prepared according to embodiments of the present invention may be suitable as fluff pulp, including fluff pulp in middle plies of 3-ply coated paperboards, printable paper substrates, etc., especially in products which incorporate BCTMP pulp fibers where embodiments of the higher bulk pulp fibers of the present invention may be used as partial or complete replacement of such BCTMP pulp fibers.

Embodiments of the pulp fibers obtained according to the present invention have certain characteristics in terms of ISO brightness (due to bleaching), increased bulk, and coarseness. These pulp fibers may have an ISO brightness of, at least about 60, for example, in the range of from about 60 to about 68, such as in the range of from about 60 to about 64, for softwood pulp fibers, and an ISO brightness of at least about 80, for example, in the range of from about 80 to about 90, such as in the range of from about 84 to about 88, for hardwood pulp fibers. These pulp fibers also may have a bulk of at least about 3.3 cc/g, such as in the range of from about 3.3 to about 4.0 cc/g for softwood pulp fibers, and at least about 1.6 cc/g, such as in the range of from about 1.6 to about 1.9 cc/g for hardwood pulp fibers. These pulp fibers may further have a coarseness in the range of from about 15 to about 45 mg/100 m. of fiber, for example, from about 32 to about 42 mg/100 m. of fiber for softwood pulp fibers, and in the range of from about 5 to about 20 mg/100 m. of fiber, for example, from about 15 to about 18 mg/100 m. of fiber for hardwood pulp fibers.

Embodiments of the pulp fibers according to the present invention also have a certain composition in terms of acid-insoluble lignin, hemicellulose, cellulose, and extractives. For softwood pulp fibers, these pulp fibers may comprise from about 15 to about 27% by weight (of the pulp fibers) of acid-insoluble lignin, such as from about 17.5 to about 25.5% by weight; from about 20 to about 25% by weight (of the pulp fibers) of hemicellulose, such as from about 21.5 to about 23.5% by weight; from about 40 to about 50% by weight (of the pulp fibers) of cellulose, such as from about 42 to about 48.5% by weight; and about 0.4% or less by weight (of the pulp fibers) of extractives, such as about 0.25% or less by weight. For unbleached softwood pulp fibers, these pulp fibers may comprise, for example, from about 23 to about 27% by weight (of the pulp fibers) of acid-insoluble lignin; from about 20 to about 23% by weight (of the pulp fibers) of hemicellulose; from about 40 to about 50% by weight (of the pulp fibers) of cellulose; and about 0.25% or less by weight (of the pulp fibers) of extractives. For bleached softwood pulp fibers, these pulp fibers may comprise, for example, from about 15 to about 20% by weight (of the pulp fibers) of acid-insoluble lignin; from about 22 to about 25% by weight (of the pulp fibers) of hemicellulose; from about 46 to about 50% by weight (of the pulp fibers) of cellulose; and about 0.01% or less by weight (of the pulp fibers) of extractives.

For hardwood pulp fibers, these pulp fibers may comprise from about 8 to about 20% by weight (of the pulp fibers) of acid-insoluble lignin, such as from about 9.5 to about 18% by weight; from about 15 to about 25% by weight (of the pulp fibers) of hemicellulose, such as from about 18.5 to about 20.5% by weight; from about 47 to about 58% by weight (of the pulp fibers) of cellulose, such as from about 48.5 to about 56.5% by weight; and from about 0.01% to about 0.08% by weight (of the pulp fibers) of extractives, such as from about 0.02 to about 0.07% by weight. For unbleached hardwood pulp fibers, these pulp fibers may comprise, for example, from about 15 to about 20% by weight (of the pulp fibers) of acid-insoluble lignin; from about 15 to about 25% by weight (of the pulp fibers) of hemicellulose; from about 47 to about 52% by weight (of the pulp fibers) of cellulose; and from about 0.05 to about 0.08% by weight (of the pulp fibers) of extractives. For bleached hardwood pulp fibers, these pulp fibers may comprise, for example, from about 8 to about 12% by weight (of the pulp fibers) of acid-insoluble lignin; from about 15 to about 25% by weight (of the pulp fibers) of hemicellulose; from about 54 to about 58% by weight (of the pulp fibers) of cellulose; and from about 0.01 to about 0.04% by weight (of the pulp fibers) of extractives.

Embodiments of the present invention also relate to a process for preparing pulp fibers. In an initial (first) step, raw wood material is cooked in an aqueous cooking liquor having a pH of at least about 8, for example, from about 8 to about 10) and comprising from about 5 to about 15% (such as from about 8 to about 12%) sodium sulfite at a temperature in the range of from about 150° to about 200° C. (such as from about 160° to about 180° C.) for at least about 30 minutes (for example, in the range of from about 30 to about 90 minutes) to provide cooked wood material. In the next (second) step, the cooked wood material is comminuted to provide using a fiberization energy of at least about 50 kj/kg (e.g., wherein the cooked materials comprises closer to 100% hardwood) at least about 150 kj/kg (e.g., wherein the cooked materials comprises closer to 100% softwood), for example, in the range of from about 150 to about 250 kj/kg (such as from about 160 to about 200 kj/kg) to provide pulp fibers. The pulp yield of these cooked pulp fibers is from about 50 to about 85%, such as in the range of from about 75 to about 85%. Prior to cooking in the aqueous cooking liquor, the raw wood material (e.g., wood chips) may be pre-steamed (to remove air from the wood chips) at a temperature in the range of from about 100° to about 110° C. The cooked pulp fibers may also be optionally, washed, refined, screened, etc.

Embodiments of the present invention also relate to a process for preparing bleached pulp fibers. The pulp fibers prepared as described above may be subjected to a bleaching step. This bleaching step may be carried out, for example, according to one of the following bleaching sequences: DP1P2; DXP1P2; or DXP1XP2, wherein D is a bleaching stage carried out with chlorine dioxide, P1 and P2 are bleaching stages carried out with one or more peroxides, and XP1 and XP2 are bleaching stages carried out with one or more peroxides and one or more optical brightening agents. Other bleaching sequences may also be used to achieve the desired brightness/whiteness in terms ISO brightness. After this bleaching step, the resulting bleached pulp fibers have the ISO brightness, bulk, and coarseness values as described above, as well as the amounts of acid-insoluble lignin, hemicellulose, cellulose, and extractives, as described above.

The pulp fibers preparing according to the pulping process of invention (with or without subsequent bleaching) may be incorporated into, for example, the inner ply of a paperboard, the an inner ply having a first and second side, a basis weight in the range of from about 100 to about 150 gsm (such as from about 120 to about 130 gsm), and a bulk of at least about 1.6 cc/g (such as from about 1.6 to about 2.0 cc/g, the inner ply comprising at least about 40% (such as, for example, from about 85 to about 95%) by weight of softwood pulp fibers, and up to about 60% (such as, for example, from about 5 to about 15%) by weight of hardwood pulp fibers. These paperboards may comprise a first outer ply comprising a paper substrate adjacent one of the first and second sides and having a basis weight of in the range of from about 35 to about 55 gsm (such as from about 40 to about 50 gsm). These paperboards may also comprise a second outer ply comprising a paper substrate adjacent the other of the first and second sides and having a basis weight in the range of from about 15 to about 35 gsm (such as from about 20 to about 30 gsm).

The first or second outer plies (or each of the first and second outer plies) has an outer coating thereon in an amount of from about 10 to about 30 gsm (such as from about 12 to about 16 gsm), the outer coating comprising from about 55 to about 85% (such as from about 62 to about 72%) solids by weight of one or more coating pigments (e.g., calcium carbonate, clays, talc, calcium sulfate, plastic pigment, titanium dioxide, silica, calcium sulfoaluminate, etc., combinations of such coating pigments) and from about 10 to about 20% (such as from about 12 to about 16%) solids by weight of one or more coating pigment binders (e.g., styrene butadiene rubber latexes, acrylic polymer latexes, polyvinyl acetate latexes, styrene acrylic copolymer latexes, etc., as well as combinations of such coating pigment binders). In some embodiments, the outer coating comprises a base coat layer adjacent the first and/or second outer plies, and a top coat layer adjacent the base coat layer. The base coat layer may be in an amount of from about 6 to about 12 gsm (such as from about 7.8 to about 9.8 gsm) and may comprise from about 60 to about 75% (such as from about 65 to about 70%) solids by weight of the coating pigment(s), and from about 11 to about 16% (such as from about 12 to about 14%) solids by weight of the coating pigment binder(s). The top coat layer may be in an amount of from about 3.5 to about 7 gsm (such as from about 4.4 to about 6.6 gsm), and may comprise from about 62 to about 70% (such as from about 64 to about 68%) solids by weight of the coating pigment(s), and from about 10 to about 15% (such as from about 11 to about 13%) solids by weight of the coating pigment binder(s).

Besides paperboard, the pulp fibers prepared according to the pulping process of invention (with or without subsequent bleaching) may in the form of fluff pulps for incorporation into products such as absorbent cores, etc. Such fluff pulps (especially fluff pulps comprising from about 90 to about 100% by weight softwood pulp fibers) may have: a shred energy of at least about 150 kj/kg, for example, from about 150 to about 250 kj/kg (such as from about 160 to about 200 kj/kg); a shred quality of about 5% or less Nits (such as about 2% or less nits); an absorption time of at least about 8 seconds, for example, from about 8 to about 20 seconds (such as from about 9 to about 15 seconds); and an absorption capacity of at least about 8 g/g, for example, from about 8 to about 10 g/g (such as from about 8.5 to about 9.5 g/g).

FIG. 1 represents graphical plot, indicated generally as 100, of bulk (in cc/g) values versus Canadian Standard Freeness (CSF) values of cooked hardwood pulp fibers prepared according to embodiment of the process of the present invention at two different cooking temperatures, i.e., those hardwood pulp fibers cooked at 160° C. being indicated by plot line 104, while those being cooked at 170° C. being indicated by plot line 108. Points 104-1 through 104-4 of plot line 104 represent the different degrees to which the hardwood pulp fibers cooked at 160° C. are refined in the PFI mill, while points 108-1 through 108-4 of plot line 108 similarly represent the different degrees to which the hardwood pulp fibers cooked at 170° C. are refined are refined in PFI mill. The lower CSF values (i.e., points 104-1 and 108-1) indicate a greater degree of refining in the PFI mill, while the higher CSF values (i.e., points 104-4 and 108-8) indicate a lesser degree of refining in the PFI mill. What these plot lines 104 and 108 of FIG. 1 show is that the bulk (cc/g value) of these hardwood pulp fibers increases as the degree of refining in the PFI mill decreases. Also, the pulp fibers cooked at 160° C. (plot line 104) are shown as having an increase in bulk relative to the hardwood pulp fibers cooked at 170° C. (plot line 108) at comparable degrees of refining in the PFI mill.

Figure 2:
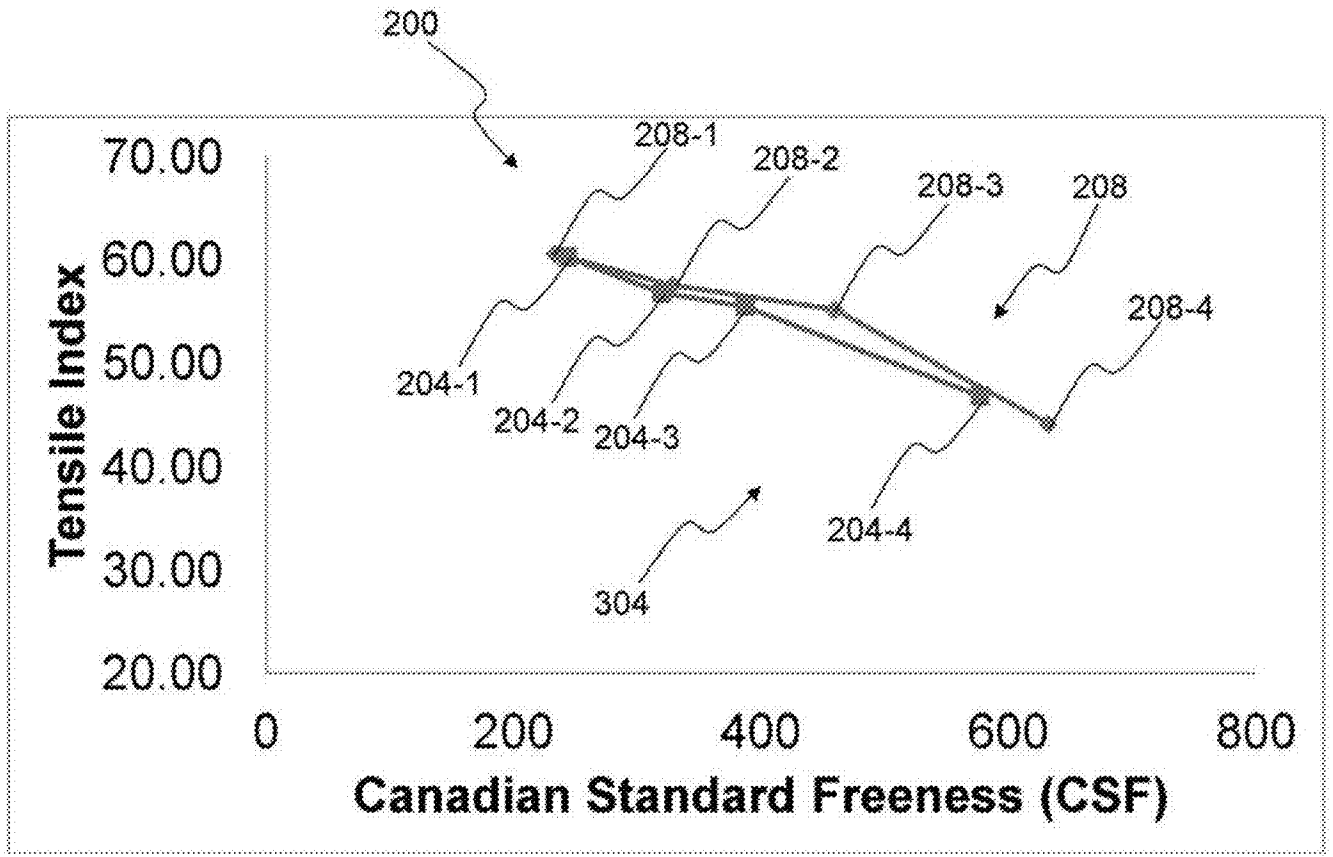
FIG. 2 is a graphical plot of the Tensile Index values versus Canadian Standard Freeness (CSF) of cooked hardwood pulp fibers prepared according to embodiment of the process of the present invention at two different cooking temperatures.

FIG. 2 represents graphical plot, indicated generally as 200, of the Tensile Index values versus Canadian Standard Freeness (CSF) values of cooked hardwood pulp fibers prepared as described for FIG. 1, i.e., those hardwood pulp fibers cooked at 160° C. being indicated by plot line 204, while those being cooked at 170° C. being indicated by plot line 208. Points 304-1 through 204-4 of plot line 204 represent the differing values of the tensile index of the hardwood pulp fibers cooked at 160° C. at decreasing CSF values, while points 208-1 through 208-4 of plot line 208 represent the differing values of the tensile index of the hardwood pulp fibers cooked at 170° C. at decreasing CSF values. Essentially, plot lines 204 and 208 show that, as the degree of refining increases (i.e., as the CSF values decrease), the tensile index correspondingly increases, reflecting the removal of parts of the fiber outer wall which allow water to penetrate the fiber making, thus making the fiber more flexible, as well as fibrillating the outer wall of the fiber to create more bonding area. In other words, this increased bonding area and fiber flexibility (by allowing the fibers to bend due to increase contact area) thus increases the tensile strength of the fiber.

EXAMPLES

Example 1

Bleached pulp fibers are prepared as follows:

Pulping Conditions: Hardwood chips and softwood chips are separately (and optionally) presteamed (to remove air from chips) at 105° C. for 10 minutes. These presteamed wood chips are then added with a sodium sulfite solution (12% by weight of the wood chips), and impregnated with the sodium sulfite solution with the temperature being increased from about 60° C. to 110° C. over a time period of 30 minutes, and then held at 110° C. for an additional 30 minutes. The impregnated softwood chips are cooked over a 30 minute time period with the cooking temperature being increased to 170° C. and then held for approximately 60 minutes at 170° C. to achieve an H-factor of 1050 with a pulp yield of 85%. The impregnated hardwood chips are cooked over a 30 minute time period with the cooking temperature being increased to 160° C. and then held for approximately 73 minutes at 160° C. to achieve an H-factor of 550 with a pulp yield of 75%.

Bleaching Conditions: For each of the softwood and hardwood pulps, three bleaching stages are used in the following order. The first bleaching stage is a D stage using 2% chlorine dioxide to which is added 1% sulfuric acid. D stage bleaching is carried out for one hour at 65° C. and a 10% consistency. The final pH of this D stage bleaching is 1.9 with no residual chlorine dioxide being present. (All weight percentages are based on pulp fibers.)

The second stage is a first peroxide (P1) bleaching stage using 1.5% hydrogen peroxide and 4% sodium hydroxide to which is also added to the D stage bleached pulp fibers 0.2% magnesium sulfate (to maintain the manganese to magnesium ratio), 0.2% diethylenetriaminepentaacetic acid (DTPA, as a chelating agent), and sodium silicate solution (as chelating agent) at 2.0% by weight also being added to the. This P1 bleaching stage is carried out for two hours at 75° C. and a 12% consistency. (All weight percentages are based on pulp fibers.)

The third stage is a second peroxide (P2) bleaching stage using 4% hydrogen peroxide and 2.5% sodium hydroxide, to which also added to the partially bleached pulp are magnesium sulfate at 0.2%, 0.2% DTPA, and 2.0% sodium silicate solution. This P2 bleaching stage is carried out for six hours at 85° C. and a 12% consistency. (All weight percentages are based on pulp fibers.)

The resulting bleached pulp has the following characteristics, as shown in Table 1:

TABLE 1

| Pulp Fiber | Bulk (cc/g.) | ISO | Lignin[1] (%) | Hemicellulose (%) | Cellulose (%) | Extractives (%) |
|---|---|---|---|---|---|---|
| Hardwood | 1.9 | 84 | 9.7 | 19.9 | 56.0 | 0.03 |
| Softwood | 3.9 | 62 | 17.5 | 23.3 | 48.4 | <0.01 |

[1]Acid-Insoluble

Example 2

Single-ply and three-ply coated paperboard sheets are prepared using a dynamic sheet former (DSF) as follows: A single-ply control coated paperboard sheet (C-2) is prepared from a mixture of 75% kraft hardwood (HW) and 25% kraft softwood (SW) pulp fibers which are refined in a PFI mill to a CSF value of 550 ml to provide basis weight of 195 gsm and a bulk 1.27 cc/g. One control coated three-ply sheet (C-1) is prepared from a bottom (B) ply comprising a mixture of 25% kraft HW and 75% SW pulp fibers refined in a PFI mill to a CSF value of 575 ml (basis weight of approximately 25 gsm), a middle (M) ply comprising a mixture of 10% kraft HW and 90% SW pulp fibers refined in a PFI mill to a CSF value of 550 ml (basis weight of approximately 125 gsm), and a top (T) ply of a mixture of 75% kraft HW and 25% kraft SW paper fibers refined in a PFI mill to a CSF value of 575 ml (basis weight of approximately 25 gsm). The total bulk of the C-1 sheet is 1.38 cc/g. Another three-ply sheet (I) is prepared from a bottom (B) ply comprising a mixture of 25% kraft HW and 75% kraft SW paper fibers refined in a PFI mill to a CSF value of 575 ml (basis weight of approximately 25 gsm), a middle (M) ply comprising a mixture of 10% kraft HW pulp fibers and 90% high bulk softwood (HBSW) pulp fibers (basis weight of approximately 125 gsm) prepared according to an embodiment of the present invention, and a top (T) ply comprising a mixture of 75% kraft HW and 25% SW paper fibers (basis weight of approximately 45 gsm). The total bulk of the I sheet is 1.52 cc/g. The HBSW pulp fibers comprising 90% of the middle (M) ply are prepared by cooking SW wood chips with 12% $Na_2SO_3$ (4:1 weight ratio of cooking liquor to wood chips) for about 1 hour, refined (as described above), and then bleached with hydrogen peroxide according to a DP1P2 bleaching sequence to an ISO value of about 65. Each of the plies is internally sized with rosin (4 to 6 lbs/ton) and surface sized with Ethylex 2025 (35 lbs/ton). The top and bottom exposed surfaces of the C-2 single ply, as well as the two 3 ply sheets are surface sized with Ethylex 2025 (35 lbs/ton). The top exposed surface of the single ply (C-2), as well as the upper exposed surface of the top (T) ply of each of the C-1 three-ply sheet and the I three ply sheet are double coated (i.e., a base and then a top coating layer) with an Everest coating using a laboratory Doyle K Coater, and then calendered using a laboratory 2 roll steel calender. The composition, including percentages of HW and SW pulp fibers, Canadian Standard Freeness, and gsm is shown in Table 2:

TABLE 2

| | | HW % | SW % | HBSW % | CSF | Gsm |
|---|---|---|---|---|---|---|
| 3-Ply (I) | T | 75 | 25 | | 575 | 45 |
| | M | 10 | | 90 | 550 | 125 |
| | B | 25 | 75 | | 575 | 25 |
| 3-Ply (C-1) | T | 75 | 25 | | 575 | 45 |
| | M | 10 | 90 | | 550 | 125 |
| | B | 25 | 75 | | 575 | 25 |
| 1-Ply (C-2) | | 75 | 25 | | 550 | 195 |

Figure 3:
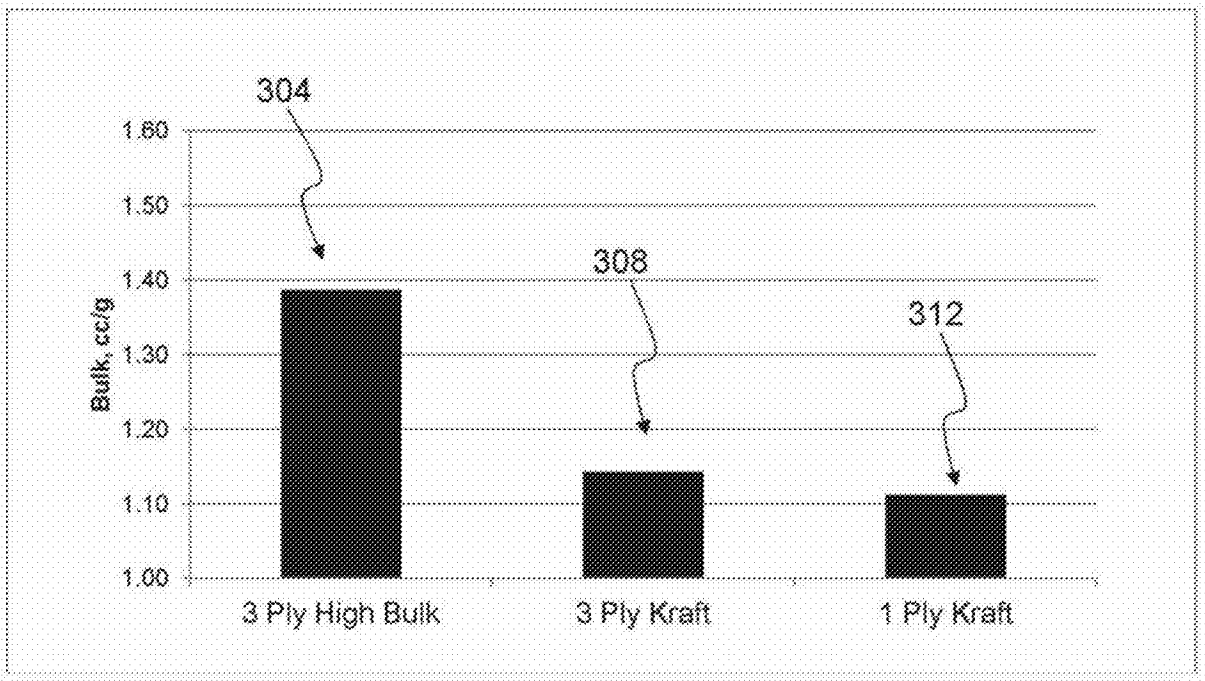
FIG. 3 shows bar graphs comparing the bulk (cc/g) of 1-ply kraft paperboard, 3-ply kraft paperboard; and 3-ply paperboard wherein the middle ply comprises paper fibers prepared according to an embodiment of the present invention.

Bar graphs of the bulk (cc/g), Sheffield smoothness, Huygen Bond, Tensile Index, and Taber Stiffness for the I (3 Ply High Bulk), C-1 (3 Ply Kraft), and C-2 (1 Ply Kraft) coated paperboards are shown in FIGS. 3 through 7. FIG. 3 compares the bulk properties of these coated paperboards with bar graph 304 representing the bulk properties of the I (3 Ply High Bulk) paperboard, bar graph 308 representing the bulk properties of the C-1 (3 Ply Kraft) paperboard, and bar graph 312 representing the bulk properties of the C-2 (1 Ply Kraft) paperboard. As shown by these bar graphs in FIG. 3, improved bulk may be achieved in these paperboards by replacing 90% of the kraft HW pulp fibers in the mid ply with HBSW pulp fibers. The bar graphs in FIG. 3 also show the increase in bulk in going from a single (C-1) to a 3 ply (C-2/I) paperboard but additionally that inclusion of the HBSW pulp fibers in the I 3 ply paperboard provides a much greater bulk improvement than simply going from single (C-1) to 3 ply (C-2) paperboard. In addition, the bar graphs in FIG. 3 show that the 3 ply (I) paperboard containing the HBSW pulp fibers retains its improved bulk, even after coating and calendering.

Figure 4:
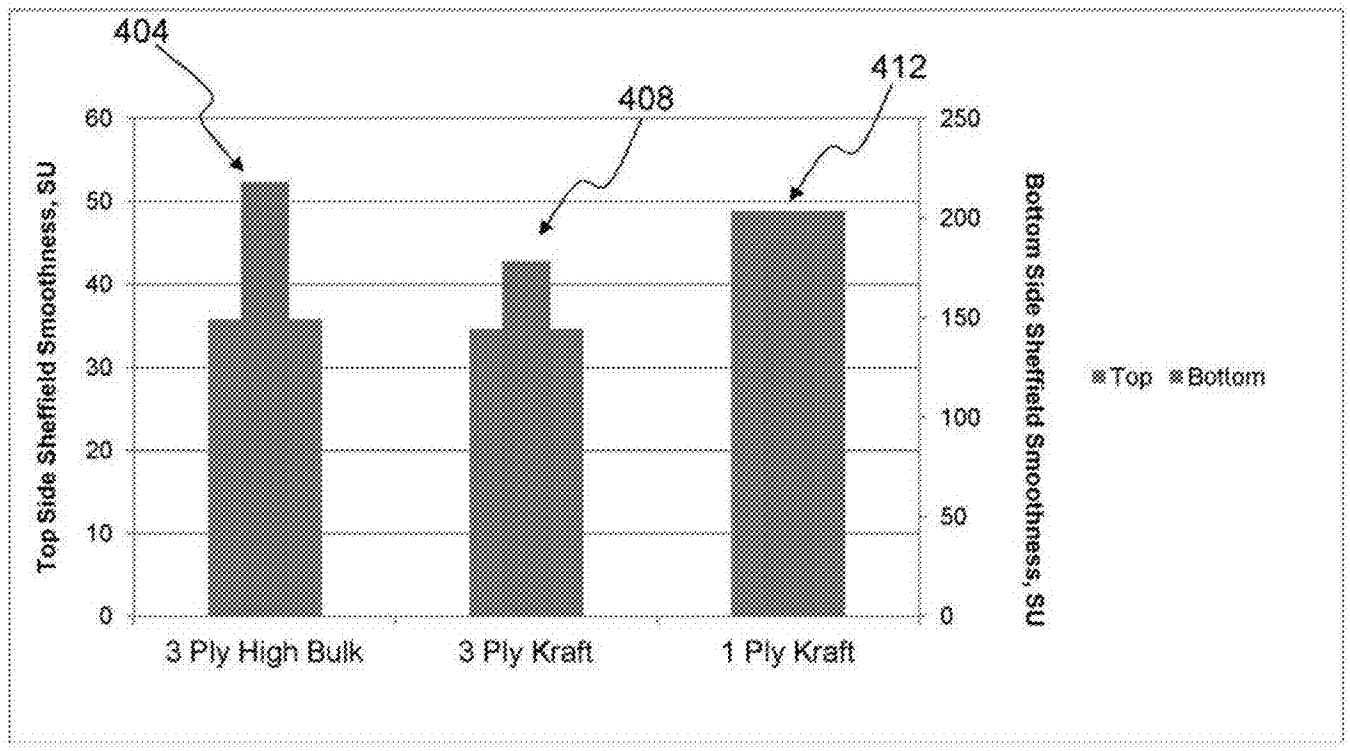
FIG. 4 shows bar graphs comparing the Sheffield smoothness of 1-ply kraft paperboard, 3-ply kraft paperboard, and 3-ply paperboard wherein the middle ply comprises paper fibers prepared according to an embodiment of the present invention.

FIG. 4 compares the Sheffield smoothness properties (top side and bottom side) of these coated paperboards with bar graph 404 representing the Sheffield smoothness properties of the I (3 Ply High Bulk) paperboard, bar graph 408 representing the Sheffield smoothness properties of the C-1 (3 Ply Kraft) paperboard, and bar graph 412 representing the Sheffield smoothness properties of for C-2 (1 Ply Kraft) paperboard. The bar graphs in FIG. 4 show that the 3 ply paperboards (I and C-2) have comparable, similar smoothness on the top (coated) side) which is significant because increasing calendering to achieve smoothness for print quality may reduce (worsen) the bulk properties of the paperboard. Additionally, if been calendered to the same smoothness as the 3 ply paperboards, the bulk properties of the single ply (C-2) paperboard may also have been lowered.

Figure 5:
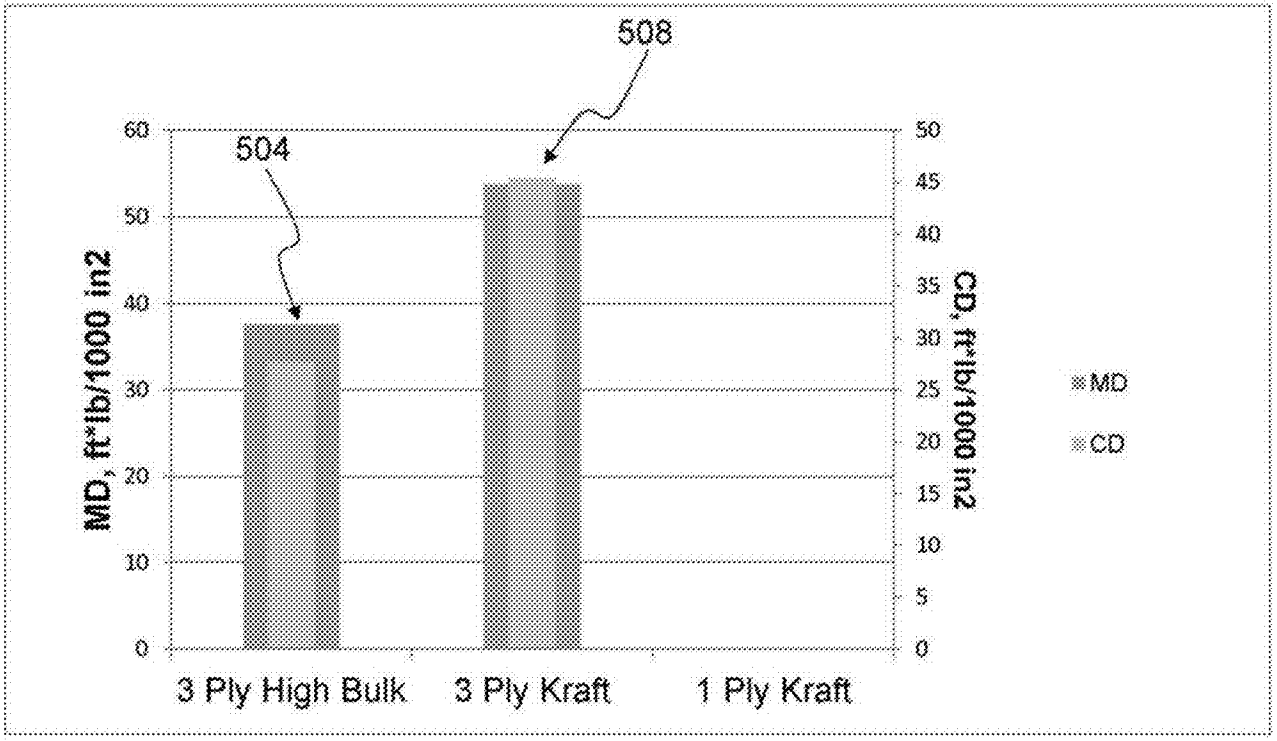
FIG. 5 shows bar graphs comparing the Huygen Bond (in the machine direction (MD) and cross-machine direction (CD)) of 3-ply kraft paperboard, and 3-ply paperboard wherein the middle ply comprises paper fibers prepared according to an embodiment of the present invention.

FIG. 5 compares the Huygen Bond properties (MD and CD) of these coated paperboards, with bar graph 504 representing the Huygen Bond smoothness properties of the I (3 Ply High Bulk) paperboard, and bar graph 508 representing the Huygen Bond smoothness properties of the C-1 (3 Ply Kraft) paperboard. FIG. 5 shows that the internal Huygen bond (or Scott bond) can be lower for the I (3 Ply) paperboard containing the HBSW pulp fibers, thus indicating that this paperboard may be slightly lower in strength compared to the C-1 (3 Ply Kraft) paperboard comprising 100% kraft pulp fibers.

Figure 6:
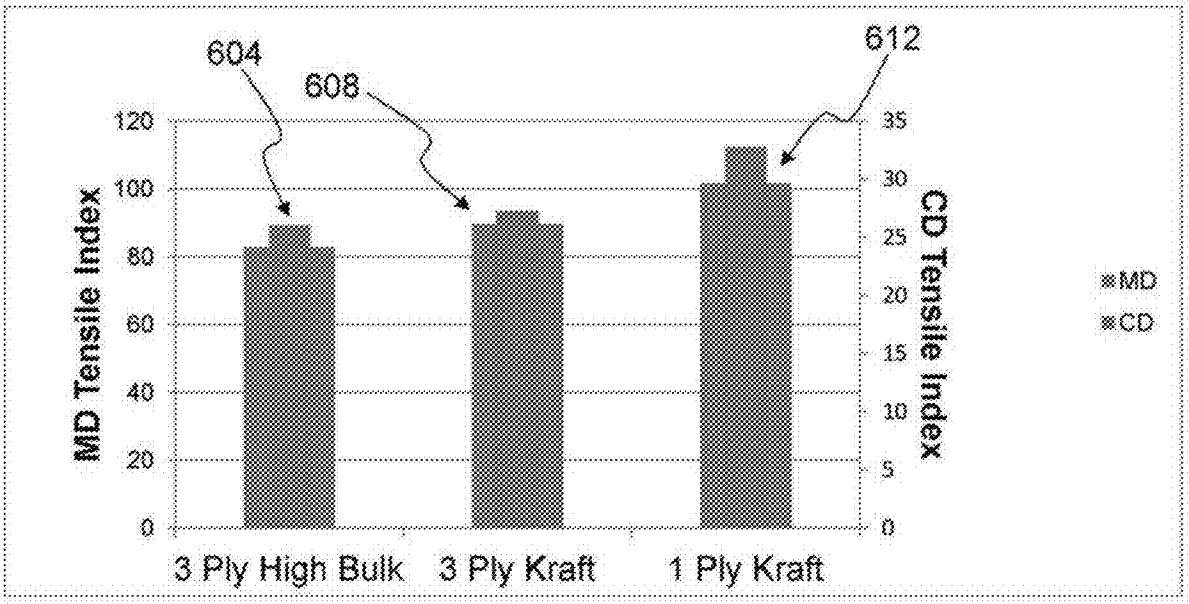
FIG. 6 shows bar graphs comparing the Tensile Index (in the machine direction (MD) and cross-machine direction (CD)) of 1-ply kraft paperboard, 3-ply paperboard, and 3-ply paperboard wherein the middle ply comprises paper fibers prepared according to an embodiment of the present invention.

FIG. 6 compares the Tensile Index properties (MD and CD) of these coated paperboards, with bar graph 604 representing the Tensile Index properties of the I (3 Ply High Bulk) paperboard, bar graph 608 representing the Tensile Index properties of the C-1 (3 Ply Kraft) paperboard, and bar graph 612 representing the Huygen Bond smoothness properties of the C-2 (1 Ply Kraft) paperboard. FIG. 6 shows minimal loss in paperboard tensile strength by including the HBSW pulp fibers in the middle ply due to the lower fiber-to-fiber bonding.

Figure 7:
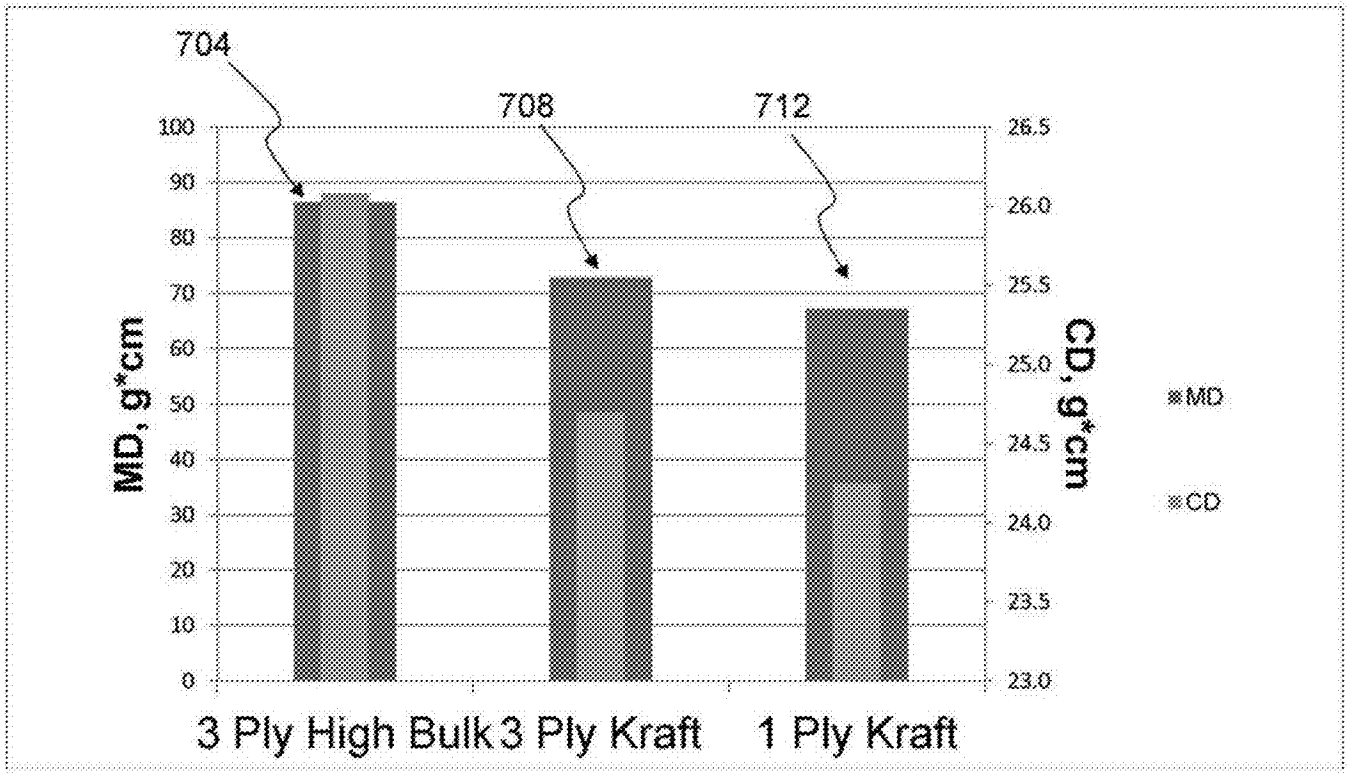
FIG. 7 represents bar graphs comparing the Taber Stiffness (in the machine direction (MD) and cross-machine direction (CD)) of 1-ply kraft paperboard, 3-ply paperboard, and 3-ply paperboard wherein the middle ply comprises paper fibers prepared according to an embodiment of the present invention.

FIG. 7 compares the Taber Stiffness properties (MD and CD) of these coated paperboards, with bar graph 704 representing the Taber Stiffness properties of the I (3 Ply High Bulk) paperboard, bar graph 708 representing the Taber Stiffness properties of the C-1 (3 Ply Kraft) paperboard, and bar graph 712 representing the Taber Stiffness properties of for C-2 (1 Ply Kraft) paperboard. Comparison of the bar graphs in FIG. 7 suggests that increase in Taber Stiffness of the I (3 Ply High Bulk) paperboard is due to the increased bulk properties of the HBSW pulp fibers included in the middle ply.

Figure 8:
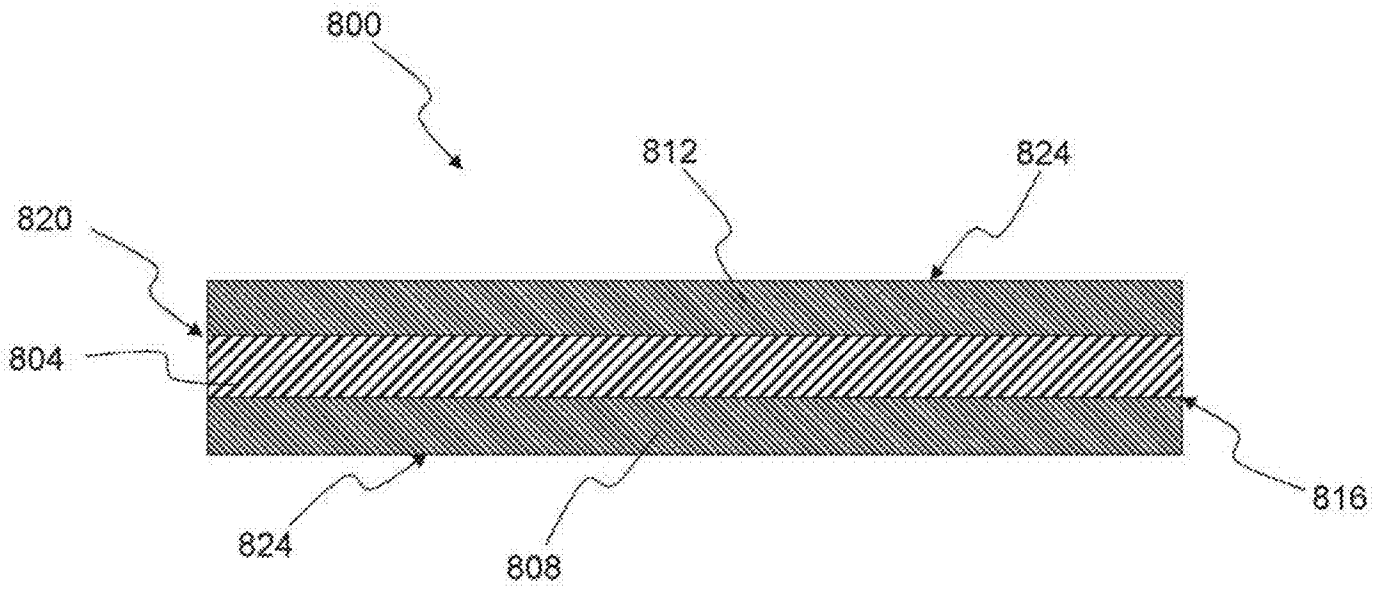
FIG. 8 is a sectional view of a three-ply paperboard having an inner (middle) ply incorporating bleached paper fibers according to an embodiment of the present invention.

An embodiment of one such three-ply coated paperboard incorporating bleached softwood (HBSW) paper fibers according to an embodiment of the present invention is illustrated in FIG. 8 (sectional view). In FIG. 8, the three-ply coated paperboard is indicated generally as 800. Paperboard 800 includes a middle (M) ply indicated generally as 804, a bottom (B) ply, indicated generally as 808, and a top (T) ply, indicated generally as 812. The interface between adjacent middle (M) ply 804 and bottom (B) ply 808, is indicated by arrow 816. The interface between adjacent middle (M) ply 804 and top (T) ply 812, is indicated by arrow 816. Arrow 824 indicates the coated surface of top (T) ply 824.

All documents, patents, journal articles and other materials cited in the present application are hereby incorporated by reference.

Although the present invention has been fully described in conjunction with several embodiments thereof with reference to the accompanying drawings, it is to be understood that various changes and modifications may be apparent to those skilled in the art. Such changes and modifications are to be understood as included within the scope of the present invention as defined by the appended claims, unless they depart therefrom.

What is claimed is:

1. A composition comprising one or more of: softwood pulp fibers having an ISO brightness of at least about 60 and a coarseness in the range of from about 15 to about 45 mg/100 m. of fiber; or hardwood pulp fibers having an ISO brightness of at least about 80 and a coarseness in the range of from about 5 to about 20 mg/100 m. of fiber, the pulp fibers comprising:

for softwood pulp fibers:

from about 15 to about 27% by weight acid-insoluble lignin;

from about 20 to about 25% by weight hemicellulose;

from about 40 to about 50% by weight cellulose; and about 0.4% or less by weight extractives; or for hardwood pulp fibers:

from about 8 to about 20% by weight acid-insoluble lignin;

from about 15 to about 25% by weight hemicellulose;

from about 47 to about 58% by weight cellulose; and from about 0.01 to about 0.08% by weight extractives.

2. The composition of claim 1, wherein the softwood pulp fibers are unbleached and comprise: from about 23 to about 27% by weight of acid-insoluble lignin; from about 20 to about 23% by weight of hemicellulose; from about 40 to about 50% by weight (of cellulose; and about 0.25% or less by weight extractives.

3. The composition of claim 1, wherein the softwood pulp fibers are bleached and comprise: from about 15 to about 20% by weight of acid-insoluble lignin; from about 22 to about 25% by weight of hemicellulose; from about 46 to about 50% by weight of cellulose; and about 0.01% or less by weight of the extractives.

4. The composition of claim 1, wherein the softwood pulp fibers have an ISO brightness of from about 60 to about 68.

5. The composition of claim 4, wherein the softwood pulp fibers have an ISO brightness of from about 60 to about 64.

6. The composition of claim 1, wherein the hardwood pulp fibers are unbleached and comprise: from about 15 to about 20% by weight of acid-insoluble lignin; from about 15 to about 25% by weight of hemicellulose; from about 47 to about 52% by weight of cellulose; and from about 0.05 to about 0.08% by weight of extractives.

7. The composition of claim 1, wherein the hardwood pulp fibers are bleached and comprise: from about 8 to about 12% by weight of acid-insoluble lignin; from about 15 to about 25% by weight of hemicellulose; from about 54 to about 58% by weight of cellulose; and from about 0.01 to about 0.04% by weight of extractives.

8. The composition of claim 1, wherein the hardwood pulp fibers have an ISO brightness of from about 80 to about 90.

9. The composition of claim 8, wherein the hardwood pulp fibers have an ISO brightness of from about 84 to about 88.

10. The composition of claim 1, wherein the softwood pulp fibers have a coarseness in the range of from about 32 to about 42, and wherein the hardwood pulp fibers have a coarseness in the range of from about 15 to about 18.

11. The composition of claim 1 in the form of a fluff pulp.

12. The composition of claim 11, wherein the fluff pulp has an absorption capacity of at least about 8 g/g for a 0.9% saline solution.

13. The composition of claim 11, wherein the fluff pulp has a shred quality of about 5% or less Nits by weight.

14. The composition of claim 11, wherein the fluff pulp has an absorption time of at least about 8 seconds for a 0.9% saline solution.

15. The composition of claim 11, wherein the fluff pulp has a shred energy of at least about 150 kj/kg.

16. The composition of claim 11, wherein the fluff pulp comprises from about 90 to about 100% by weight softwood pulp fibers.

17. The composition of claim 16, wherein the fluff pulp has an absorption capacity of from about 8 to about 10 g/g for a 0.9% saline solution.

18. The composition of claim 16, wherein the fluff pulp has an absorption capacity of from about 8.5 to about 9.5 g/g for a 0.9% saline solution.

19. The composition of claim 16, wherein the fluff pulp has a shred quality of about 5% or less Nits by weight.

20. The composition of claim 16, wherein the fluff pulp has a shred quality of about 2% or less Nits by weight.

21. The composition of claim 16, wherein the fluff pulp has an absorption time of from about 8 to about 20 seconds for a 0.9% saline solution.

22. The composition of claim 16, wherein the fluff pulp has an absorption time of from about 9 to about 15 seconds for a 0.9% saline solution.

23. The composition of claim 16, wherein the fluff pulp has a shred energy of from about 150 to about 250 kj/kg.

24. The composition of claim 16, wherein the fluff pulp has a shred energy of from about 160 to about 200 kj/kg.

25. A process for preparing pulp fibers, the process comprising the following steps:

(a) cooking raw wood material comprising one or more of softwoods or hardwoods in an aqueous cooking liquor comprising from about 8 to about 12% sodium sulfite at a temperature in the range of from about 150° to about 200° C. for at least about 30 minutes to provide cooked wood material; and (b) comminuting the cooked wood material of step (a) using a fiberization energy of at least about 50 kj/kg to provide pulp fibers in a yield of from about 50 to about 85% and having:

for softwood pulp fibers, an ISO brightness of at least about 60 and a coarseness in the range of from about 15 to about 45 mg/100 m., the softwood pulp fibers comprising:

from about 23 to about 27% by weight acid-insoluble lignin;

from about 20 to about 23% by weight hemicellulose;

from about 40 to about 45% by weight cellulose; and about 0.4% or less by weight extractives; or for hardwood pulp fibers, an ISO brightness of at least about 80 and a coarseness in the range of from about 5 to about 20 mg/100 m., the hardwood pulp fibers comprising:

from about 15 to about 20% by weight acid-insoluble lignin;

from about 15 to about 25% by weight hemicellulose;

from about 47 to about 52% by weight cellulose; and about 0.05 to about 0.08% by weight extractives.

26. The process of claim 25, wherein the raw wood material comprises wood chips.

27. The process of claim 25, wherein the fiberization energy used in step (b) is at least about 150 kj/kg.

28. The process of claim 27, wherein the fiberization energy used in step (b) in the range of from about 150 to about 250 kj/kg.

29. The process of claim 28, wherein the fiberization energy used in step (b) in the range of from about 160 to about 200 kj/kg.

30. The process of claim 25, wherein step (a) is carried out at a temperature in the range of from about 160° to about 180° C.

31. The process of claim 30, wherein step (a) is carried out for from about 30 to about 90 minutes.

32. The process of claim 25, wherein the softwood pulp fibers of step (b) have a coarseness in the range of from about 32 to about 42, and wherein the hardwood pulp fibers of step (b) have a coarseness in the range of from about 15 to about 18.

33. A process for preparing bleached pulp fibers, the process comprising the following steps:

(a) cooking raw wood material comprising one or more of softwoods or hardwoods in an aqueous cooking liquor comprising from about 8 to about 12% sodium sulfite at a temperature in the range of from about 150° to about 200° C. for at least about 30 minutes to provide cooked wood material;

(b) comminuting the cooked wood material of step (a) using a fiberization energy of at least about 50 kj/kg to provide pulp fibers in a yield of from about 50 to about 85%; and (c) bleaching the pulp fibers of step (b) to provide bleached softwood pulp fibers having an ISO brightness of at least about 60 and a coarseness of from about 15 to about 45 mg/100 m. of fiber; or hardwood pulp fibers having an ISO brightness of at least about 80 and a coarseness in the range of from about 5 to about 20 mg/100 m. of fiber, the bleached pulp fibers comprising:

for bleached softwood pulp fibers:

from about 15 to about 20% by weight acid-insoluble lignin;

from about 22 to about 25% by weight hemicellulose;

from about 46 to about 50% by weight cellulose; and about 0.01% or less by weight extractives; or for bleached hardwood pulp fibers:

from about 8 to about 12% by weight acid-insoluble lignin;

from about 15 to about 25% by weight hemicellulose;

from about 54 to about 58% by weight cellulose; and from about 0.01 to about 0.04% by weight extractives.

34. The process of claim 33, wherein the raw wood material comprises wood chips.

35. The process of claim 33, wherein the fiberization energy used in step (b) is at least about 150 kj/kg.

36. The process of claim 35, wherein the fiberization energy used in step (b) in the range of from about 150 to about 250 kj/kg.

37. The process of claim 36, wherein the fiberization energy used in step (b) in the range of from about 160 to about 200 kj/kg.

38. The process of claim 33, wherein step (a) is carried out at a temperature in the range of from about 160° to about 180° C.

39. The process of claim 36, wherein step (a) is carried out for from about 30 to about 90 minutes.

40. The process of claim 33, wherein step (c) is carried out according to a DP1P2 bleaching sequence.

41. The process of claim 33, wherein bleaching step (c) is carried out according to according to one of the following bleaching sequences: DP1P2; DXP1P2; or DXP1XP2, wherein D is a delignification stage carried out with chlorine dioxide, P1 and P2 are bleaching stages carried out with one or more peroxides, and XP1 and XP2 are bleaching stages carried out with one or more peroxides in the presence of one or more optical brightening agents.

42. The process of claim 41, wherein bleaching step (c) is carried out according to a DP1P2 bleaching sequence.

43. The process of claim 42, wherein the one or more peroxides of bleaching step (c) comprises hydrogen peroxide.

44. The process of claim 42, wherein step (c) is carried out according to a DXP1XP2 or a DXP1P2 bleaching sequence.

45. The process of claim 44, wherein step (c) is carried out according to a DXP1P2 bleaching sequence.

46. The process of claim 44, wherein the one or more optical brightening agents of step (c) are in an amount of from about from about 0.2 to about 2% by weight of the pulp fibers.

47. The process of claim 46, wherein the one or more optical brightening agents of step (c) are in an amount of from about from about 0.4 to about 0.6% by weight of the pulp fibers.

48. The process of claim 33, wherein the one or more optical brightening agents of step (c) are one or more stilbene-based sulfonates.

49. The process of claim 33, wherein step (c) provides bleached softwood pulp fibers having an ISO brightness of from about 60 to about 64, and bleached hardwood pulp fibers having an ISO brightness of from about 80 to about 84.

50. The process of claim 33, wherein the softwood pulp fibers of step (c) have a coarseness in the range of from about 32 to about 42, and wherein the hardwood pulp fibers of step (c) have a coarseness in the range of from about 15 to about 18.

51. An article comprising paperboard having a thickness of from about 10 to about 24 mils, the paperboard comprising:

an inner ply having a first and second side, a basis weight in the range of from about 100 to about 150 gsm, and a bulk of at least about 1.6 cc/g, the inner ply comprising at least about 40% by weight of softwood pulp fibers, and up to about 60% by weight of hardwood pulp fibers, the softwood pulp fibers having an ISO brightness of at least about 60 and the hardwood pulp fibers having an ISO brightness of at least about 80, and wherein:

the softwood pulp fibers comprise:

from about 15 to about 27% by weight acid-insoluble lignin;

from about 20 to about 25% by weight hemicellulose;

from about 40 to about 50% by weight cellulose; and about 0.4% or less by weight extractives; and the hardwood pulp fibers comprise:

from about 8 to about 20% by weight acid-insoluble lignin;

from about 15 to about 25% by weight hemicellulose;

from about 47 to about 58% by weight cellulose; and from about 0.01 to about 0.08% by weight extractives;

a first outer ply comprising a paper substrate adjacent one of the first and second sides and having basis weight of in the range of from about 35 to about 55 gsm; and a second outer ply comprising a paper substrate adjacent the other of the first and second sides and having a basis weight in the range of from about 15 to about 35 gsm;

wherein at least one of the first and second outer plies has an outer coating thereon in an amount of from about 10 to about 30 gsm, the outer coating comprising from about 55 to about 85% solids by weight of what of one or more coating pigments and from about 10 to about 20% solids by weight of one or more coating pigment binders.

52. The article of claim 51, wherein the paperboard has a caliper of from about 12 to about 18 mils.

53. The article of claim 51, wherein the inner ply has a basis weight in the range of from about 120 to about 130 gsm, wherein the first outer ply has a basis weight in the range of from about 40 to about 50 gsm, and wherein the second outer ply has a basis weight in the range of from about 20 to about 30 gsm.

54. The article of claim 51, wherein the outer coating is in an amount of from about 12 to about 16 gsm.

55. The article of claim 51, wherein each of the first and second outer plies has an outer coating thereon.

56. The article of claim 51, wherein the coating pigments comprise one or more of: calcium carbonate, clay, talc, calcium sulfate, plastic pigment, titanium dioxide, silica, or calcium sulfoaluminate, and wherein the coating pigment binders comprise one or more of: styrene butadiene rubber latexes, acrylic polymer latexes, polyvinyl acetate latexes, or styrene acrylic copolymer latexes.

57. The article of claim 56, wherein the coating pigments comprise one or more of: calcium carbonate or clay.

58. The article of claim 51, wherein the outer coating comprises a base coat layer adjacent the at least one first and/or second outer plies, and a top coat layer adjacent the base coat layer, the base coat layer being in an amount of from about 6 to about 12 gsm, and comprising from about 60 to about 75% solids by weight of the one or more coating pigments, and from about 11 to about 16% solids by weight of the one or more coating pigment binders, the top coat layer being in an amount of from about 3.5 to about 7 gsm, and comprising from about 62 to about 70% solids by weight of the one or more coating pigments, and from about 10 to about 15% solids by weight of the one or more coating pigment binders.

59. The article of claim 58, wherein the base coat layer being in an amount of from about 7.8 to about 9.8 gsm, and comprises from about 65 to about 70% solids by weight of the one or more coating pigments, and from about 12 to about 14% solids by weight of the one or more coating pigment binders, wherein the top coat layer being in an amount of from about 4.4 to about 6.6 gsm, and comprises from about 64 to about 68% solids by weight of the one or more coating pigments, and from about 11 to about 13% solids by weight of the one or more coating pigment binders.

* * * * *